US006729691B2

(12) United States Patent
Koepke et al.

(10) Patent No.: US 6,729,691 B2
(45) Date of Patent: May 4, 2004

(54) CHAIR BACK CONSTRUCTION

(75) Inventors: Marcus C. Koepke, Indianapolis, IN (US); Tim Coffield, Grand Rapids, MI (US); Jay R. Michael, Muscatine, IA (US); Matthew J. Phillips, Muscatine, IA (US); Douglas A. Schroeder, Muscatine, IA (US); Craig H. Schultz, Muscatine, IA (US); Erik A. Steffensen, Iowa City, IA (US)

(73) Assignee: Hon Technology, Inc., Muscatine, IA (US)

( * ) Notice: Subject to any disclaimer, the term of this patent is extended or adjusted under 35 U.S.C. 154(b) by 48 days.

(21) Appl. No.: 10/077,540

(22) Filed: Feb. 15, 2002

(65) Prior Publication Data

US 2003/0001425 A1 Jan. 2, 2003

Related U.S. Application Data

(63) Continuation-in-part of application No. 09/882,140, filed on Jun. 15, 2001, now Pat. No. 6,572,190, and a continuation-in-part of application No. 09/881,795, filed on Jun. 15, 2001, now Pat. No. 6,572,190.

(51) Int. Cl.[7] ..... A47C 7/02

(52) U.S. Cl. ..... 297/452.56; 297/452.13; 297/452.64

(58) Field of Search ..... 297/452.13, 452.64, 297/452.56, 452.18, 440.2, 218.1, 230.11, 352, 452.59, 230.1

(56) References Cited

U.S. PATENT DOCUMENTS

| | | | | |
|---|---|---|---|---|
| 2,059,940 A | | 11/1936 | Freedman | |
| 3,008,764 A | * | 11/1961 | Pile | 297/301.1 |
| 3,019,051 A | | 1/1962 | Nugent | |
| 3,258,259 A | | 6/1966 | Bohlin | |
| 3,339,873 A | | 9/1967 | Hale | |
| 3,547,394 A | | 12/1970 | Wehner | |

(List continued on next page.)

*Primary Examiner*—Peter M. Cuomo
*Assistant Examiner*—Stephanie Harris
(74) *Attorney, Agent, or Firm*—Ronald A. Sandler; Jones Day

(57) ABSTRACT

A chair back is disclosed and includes a mesh material connected to a two-piece carrier, the carrier being deformable and stretchable. The carrier has a bottom edge including a groove and is engageable by tabs attached to a transverse member of a chair frame assembly. The upper ends of the carrier each includes an opening for receiving a spherical end portion of the upper end of the chair frame assembly. Engagement of the carrier with the chair frame assembly is accomplished by stretching the carrier and mesh between the transverse member and the spherical end portions. The chair back includes a lumbar support which is mounted to slide along the side edges of the carrier and along vertical supports of the chair frame assembly, the lumbar support causing the chair to tension forwardly. The chair back is pivotal under the influence of a chair user and is pivotally connected to the chair seat so as to cause the chair seat to also pivot in response.

15 Claims, 33 Drawing Sheets

U.S. PATENT DOCUMENTS 3,711,156 A 1/1973 Bloomfield
3,794,382 A 2/1974 Bloomfield et al.
4,155,592 A 5/1979 Tsuda et al.
4,159,847 A 7/1979 Arai
4,270,798 A 6/1981 Harder, Jr.
4,309,058 A 1/1982 Barley
4,429,918 A 2/1984 Alsup, Jr. et al.
4,907,835 A 3/1990 Salters
4,917,438 A 4/1990 Morgan
4,940,202 A 7/1990 Hosan et al.
5,382,079 A 1/1995 Wilson et al.
5,393,124 A 2/1995 Neil
5,398,993 A * 3/1995 Chen ..... 297/230.11
5,439,267 A 8/1995 Peterson et al.
5,507,559 A 4/1996 Lance
5,507,563 A * 4/1996 Arthur, Jr. ..... 297/440.23
5,716,101 A * 2/1998 Frinier et al. ..... 297/440.22
5,762,403 A * 6/1998 Robinson ..... 297/440.11
5,797,652 A 8/1998 Darbyshire
5,810,439 A * 9/1998 Roslund, Jr. ..... 297/300.4
5,908,221 A 6/1999 Neil
6,035,901 A 3/2000 Stumpf et al.
6,050,646 A 4/2000 Stenzel et al.
6,059,368 A * 5/2000 Stumpf et al. ..... 297/440.11
6,125,521 A 10/2000 Stumpf et al.
6,254,190 B1 * 7/2001 Gregory ..... 297/452.1
6,305,747 B1 * 10/2001 Mei ..... 297/354.11
6,361,117 B1 * 3/2002 Tate ..... 297/452.56
6,439,661 B1 * 8/2002 Brauning ..... 297/300.2
6,517,161 B2 * 2/2003 Lo ..... 297/440.11
6,540,950 B1 * 4/2003 Coffield ..... 264/57
6,550,866 B1 * 4/2003 Su ..... 297/452.42

* cited by examiner

CHAIR BACK CONSTRUCTION

CROSS REFERENCE TO RELATED APPLICATION

The present application is a continuation-in-part of application Ser. No. 09/882,140, filed Jun. 15, 2001, entitled "Chair Back Construction", and application Ser. No. 09/881,795 filed Jun. 15, 2001 entitled "Lumbar Support For A Chair"now U.S. Pat. No. 6,572,190, and is related to co-pending application Ser. No. 10/077,409 entitled "Improved Ergonomic Chair" filed on even date here with and commonly assigned, the disclosures of which are incorporated herein by reference.

BACKGROUND OF THE INVENTION

1. Field of the Invention

The present invention relates generally to a chair of the type suitable for use in an office environment and, more particularly, to a reclining office chair having several structural and operating features which offer a number of ergonomic advantages over the prior art including a highly functional and aesthetically pleasing chair back.

2. Description of the Related Art

Over many years attempts have been made to design chairs for use in office environments which are comfortable to use and thereby avoid user fatigue over prolonged use. In one simple form a chair may be provided with a swivel base for ease of turning and include a control mechanism which permits the chair to rock. A disadvantage of these relatively simple chairs is that conjoint rocking motion of the chair seat and back naturally lifts the user's feet off the floor, which can create stability problems and place upward force on the front of the user's thighs which can reduce fluid circulation in the user's legs.

To improve on the foregoing chair construction, chair controls are known which provide for synchronous movement of the chair seat and back. Where office chairs are concerned, a "synchronous control" means the arrangement of a combined or dependent back adjustment and seat adjustment, that is to say the adjustment of the back inclination fundamentally also results in an adjustment of the sitting surface. An example of a synchronous chair control is disclosed in U.S. Pat. No. 5,318,345, issued to Olson and assigned to the common assignee herein. With the aforementioned Olson control, the chair back is designed to tilt at one predetermined rate of recline while the seat tilts synchronously at a much lesser rate. The result is that the user's feet are not lifted from the floor when the back is reclined. Also, fluid circulation in the user's legs is not interrupted by substantial upward movement of the forward end of the seat. Another advantage of this control is that undesirable "shirt pull" is minimized by the strategic location of the tilt axis. Other examples of synchronous chair controls are disclosed in U.S. Pat. Nos. 5,366,274 and 5,860,701 to name a few.

Another feature embodied in recently designed office chairs that offers considerable ergonomic advantages is a tilt limiter feature for the chair back. With such a mechanism built into the chair control, the user may selectively set the degree of back recline at a predetermined angle thereby adding to comfort as the chair is used. An example of such a tilt limiter mechanism is disclosed in U.S. Pat. No. 6,102,477 issued to Kurtz and assigned to the common assignee herein. This particular mechanism offers the advantage of providing for infinitely variable angles of tilt within a predetermined overall range. The mechanism is also highly cost-effective to construct.

Yet another feature of current ergonomically designed chairs is the provision of height and pivot adjustable arm pads. Such a feature is particularly advantageous in providing the user with additional support to the arms, forearms, wrists and shoulders in order to minimize repetitive stress injuries when the user is keyboarding, for example, while seated in the chair. An example of such an adjustable arm pad is disclosed in U.S. Pat. No. 5,908,221 issued to Neil. One advantage of the '221 structure is that it uses gas cylinders for arm pad height adjustment and thus is easily adjusted with the push of a single button.

Yet another feature of current ergonomically designed office chairs includes an adjustable lumbar support mechanism for providing preselected chair back tension in the region of the user's lower back. An adjustable lumbar support allows the chair user to select a comfortable level of pressure on the lower back depending upon the specific office task being performed. Such a mechanism is disclosed, for example, in U.S. Pat. No. 5,797,652.

Still another feature of certain ergonomically designed office chairs, particularly of recent vintage, is the incorporation of fabric mesh into the construction of the chair seat, and/or back. While mesh materials are well-known in the construction of lawn furniture seating, it has only been relatively recently that such materials have been used successfully in office seating. These materials offer the advantage of enhanced air circulation for and consequent heat transfer from the chair user's body, which can improve the comfort of the chair. An example of the use of such fabric mesh in an office chair is disclosed in U.S. Pat. No. 6,125,521 issued to Stumpf et al.

Yet another feature of certain ergonomically designed chairs is the provision of a seat cushion having the capability of effecting heat transfer from the chair user's buttocks area while at the same time offering comfort to the user while seated, together with adequate support. Known seat cushions having such capability may involve a passive or active air flow circulation feature of the type disclosed, for example, in U.S. Pat. No. 6,179,706.

BRIEF SUMMARY OF THE INVENTION

What is described here is a chair back comprising a material for engaging a back of a chair user, and a carrier connected to the back engaging material, the carrier configured to connect to a chair frame assembly only along the lower portion of the carrier and along an upper portion of the carrier.

There are a number of advantages, features and objects achieved with the present invention which are believed not to be available in earlier related device. For example, one advantage is that the present invention provides a comfortable chair that conforms to the chair user. Another object of the present invention is to provide a chair that is aesthetically pleasing. A further advantage of the present invention is to provide a chair that is easy to form and to assemble. A further feature of the present invention is to provide a chair that is simply constructed and reliable in operation.

A more complete understanding of the present invention and other objects, advantages and features thereof will be gained from a consideration of the following description of preferred embodiments read in conjunction with the accompanying drawing provided herein. The preferred embodiments represent examples of the invention which is described here in compliance with Title 35 U.S.C. section 112, but the invention itself is defined by the attached claims.

DETAILED DESCRIPTION OF THE PREFERRED EMBODIMENTS

Figure 1:
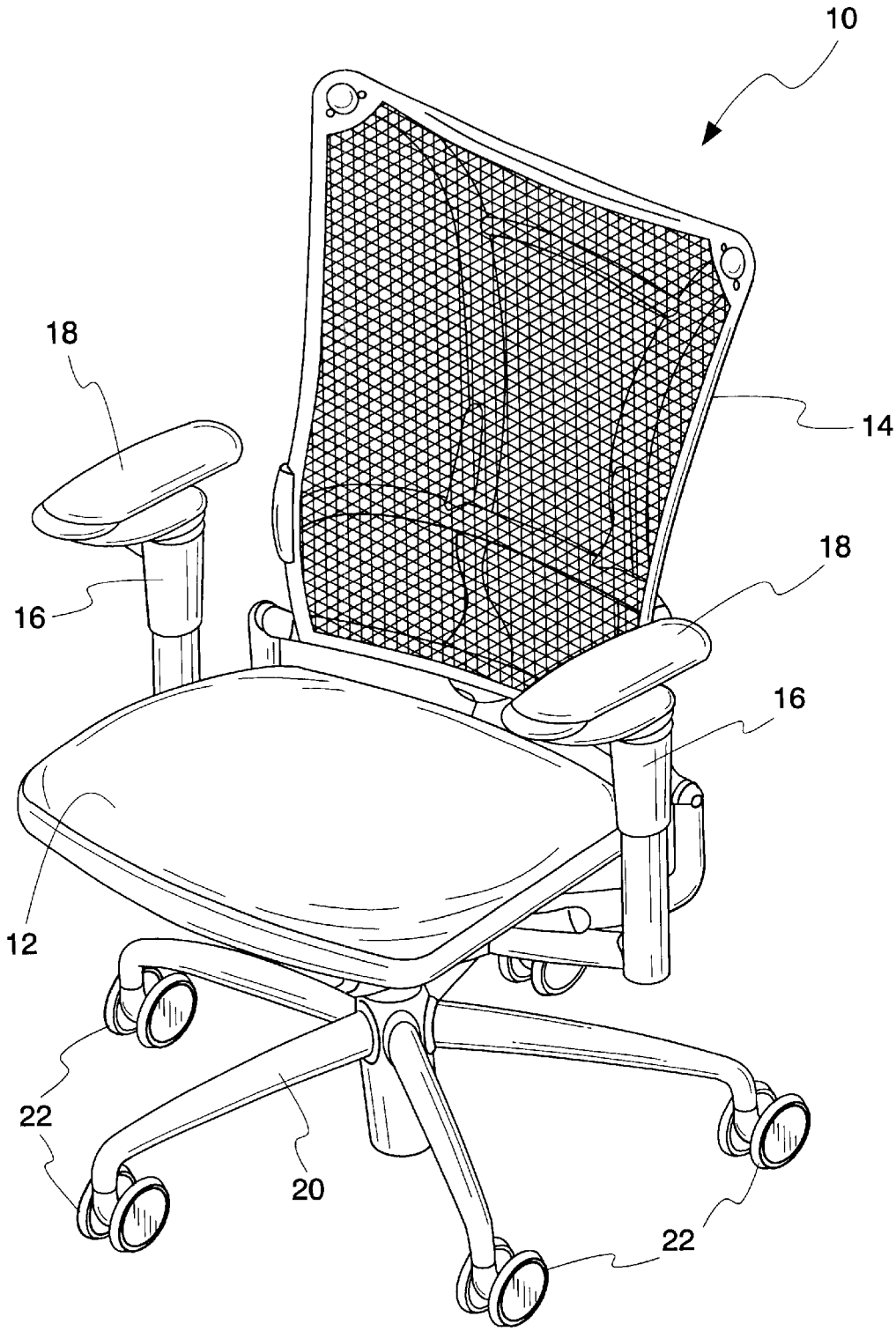
FIG. 1 is a left front isometric view of an ergonomic chair.

While the present is open to various modifications and alternative constructions, the preferred embodiments shown in the drawing will be described herein in detail. It is understood, however, that there is no intention to limit the invention to the particular embodiments, forms or examples disclosed. On the contrary, the intention is to cover all modifications, equipment, structures and methods and alternative constructions falling within the spirit and scope of the invention as express in the appended claims, pursuant to Title 35 U.S.C. section 112 (second paragraph).

Figure 2:
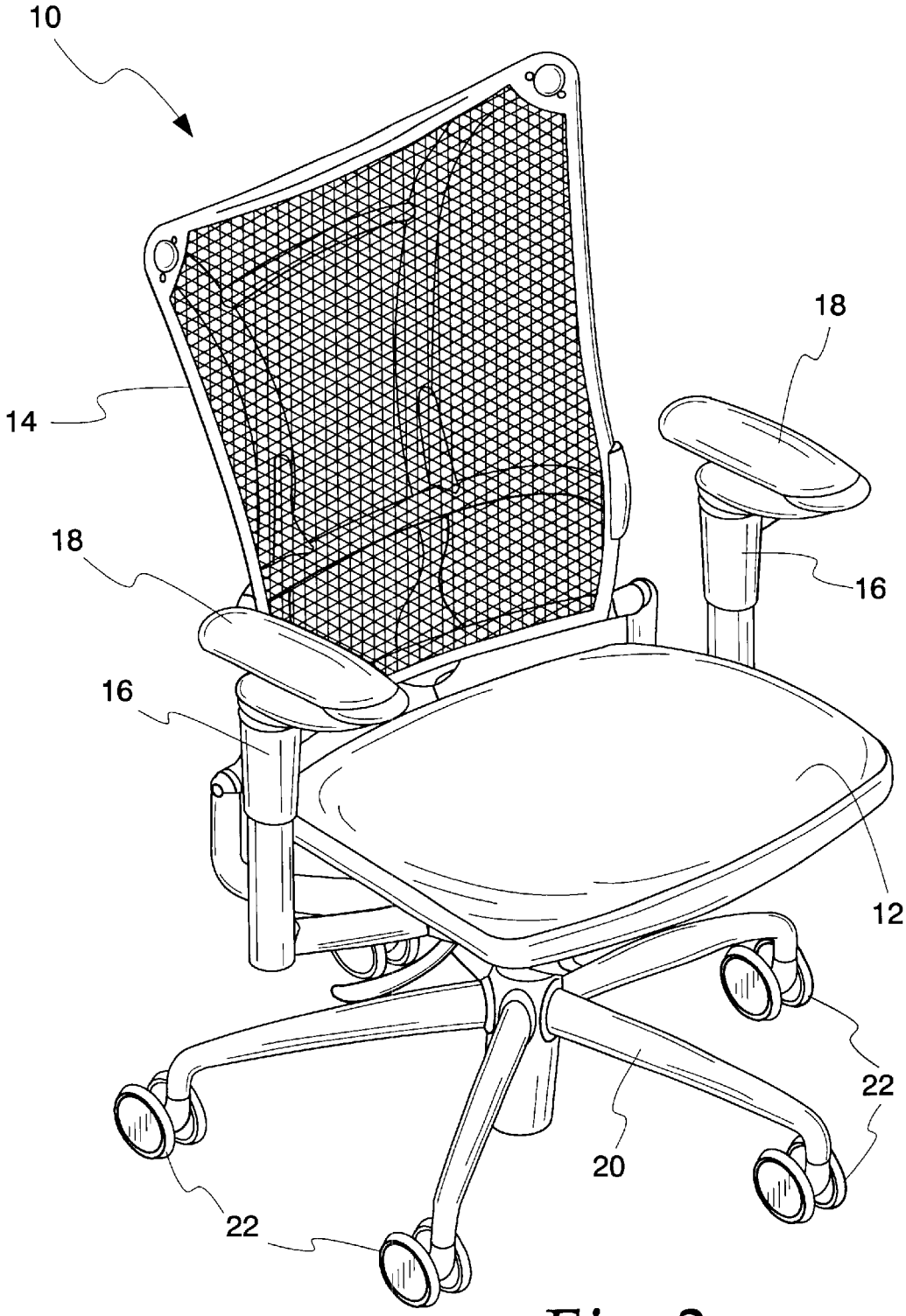
FIG. 2 is a right front isometric view of the chair.
Figure 2A:
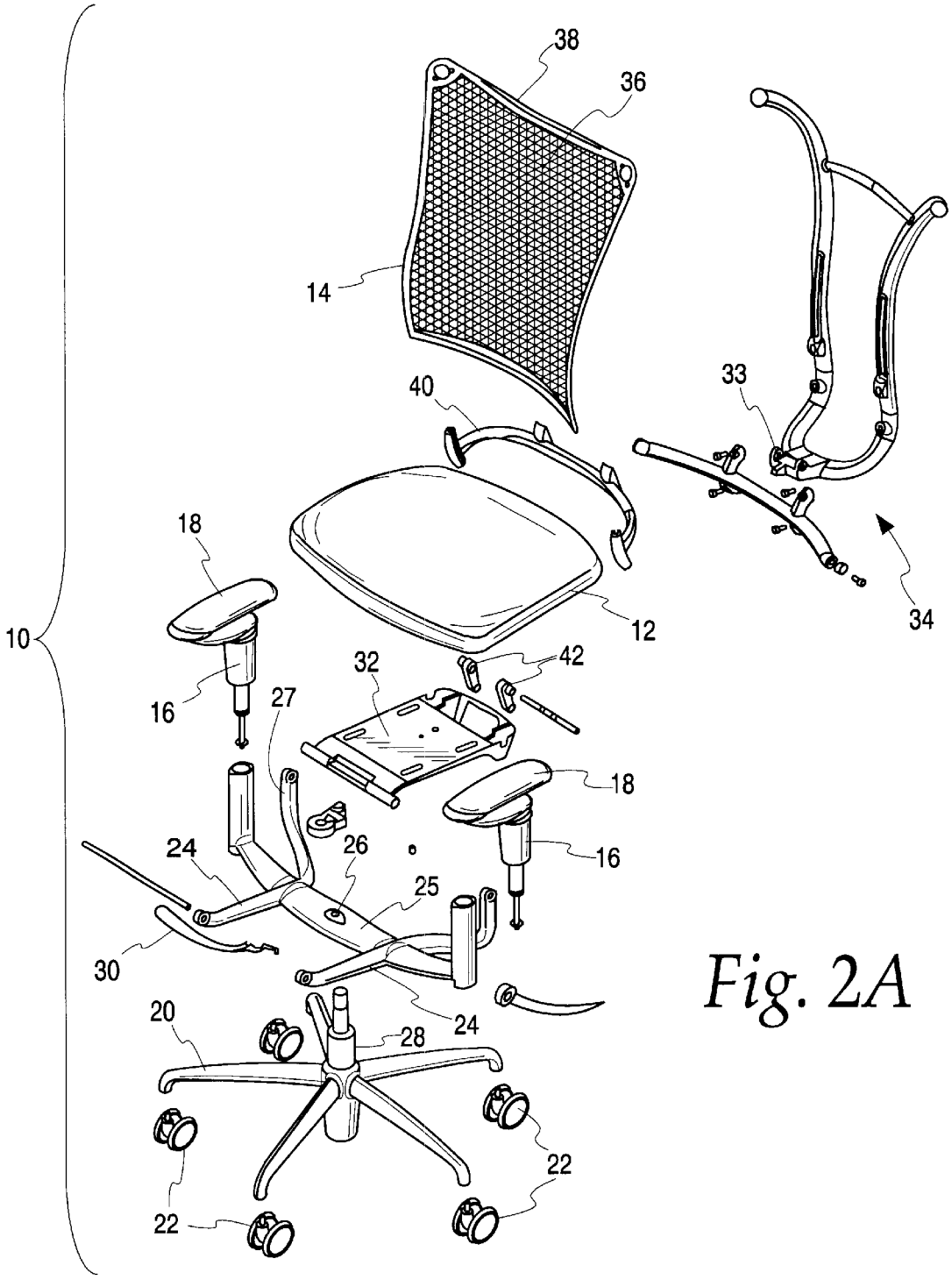
FIG. 2A is an exploded isometric view of the chair shown in FIGS. 1 and 2.
Figure 3:
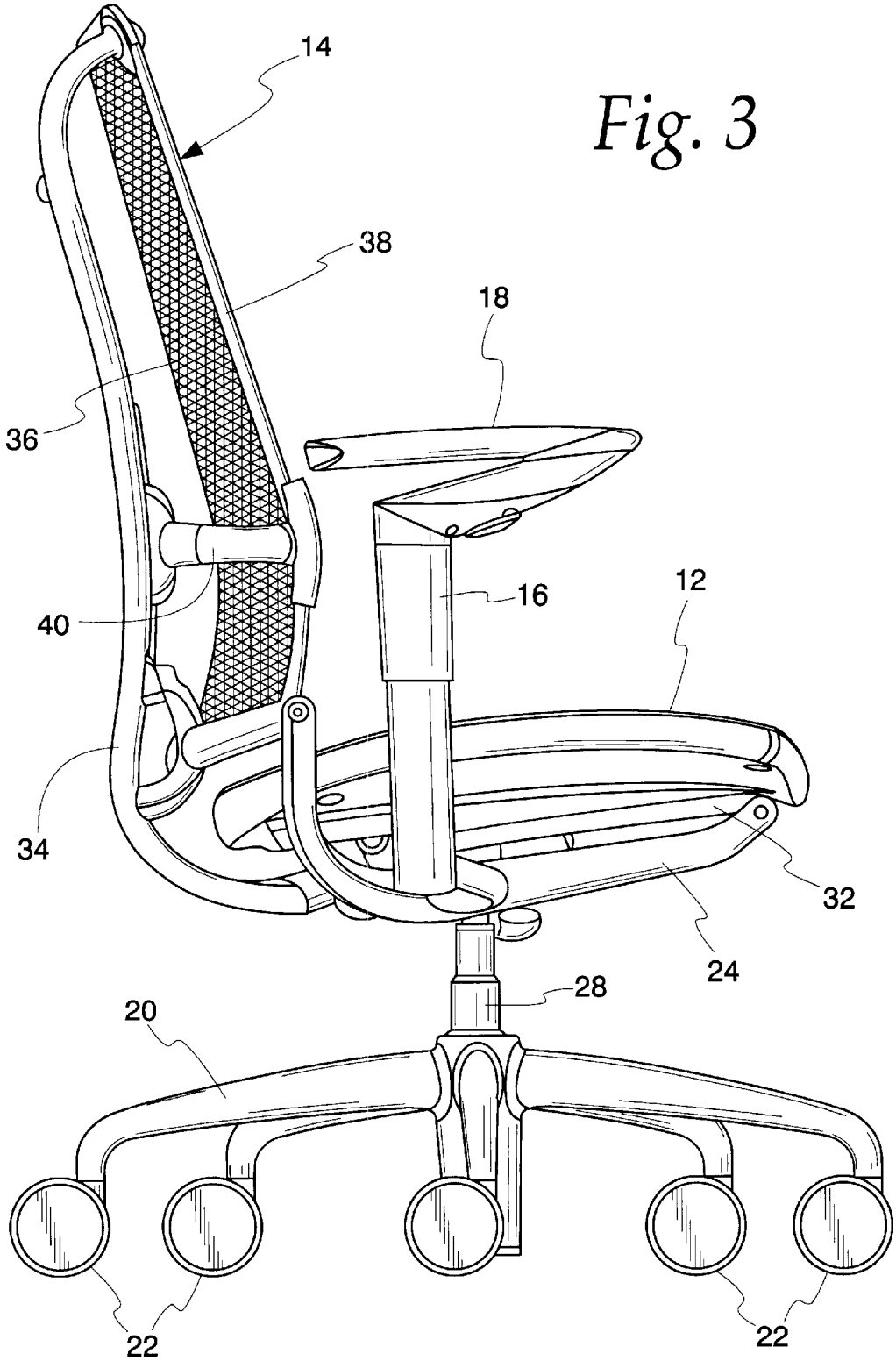
FIG. 3 is a right elevation view of the chair.
Figure 4:
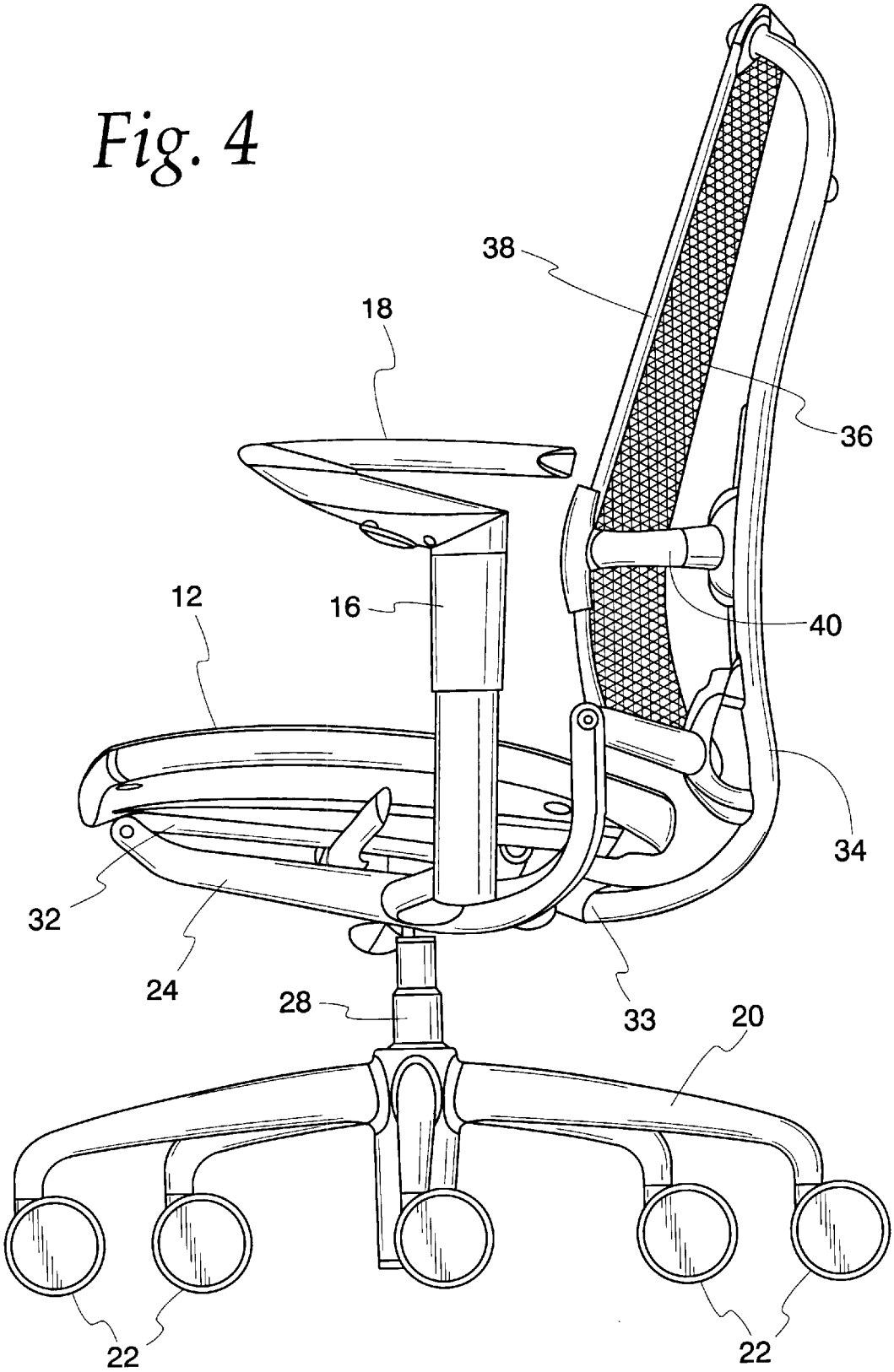
FIG. 4 is a left elevation view of the chair.
Figure 5:
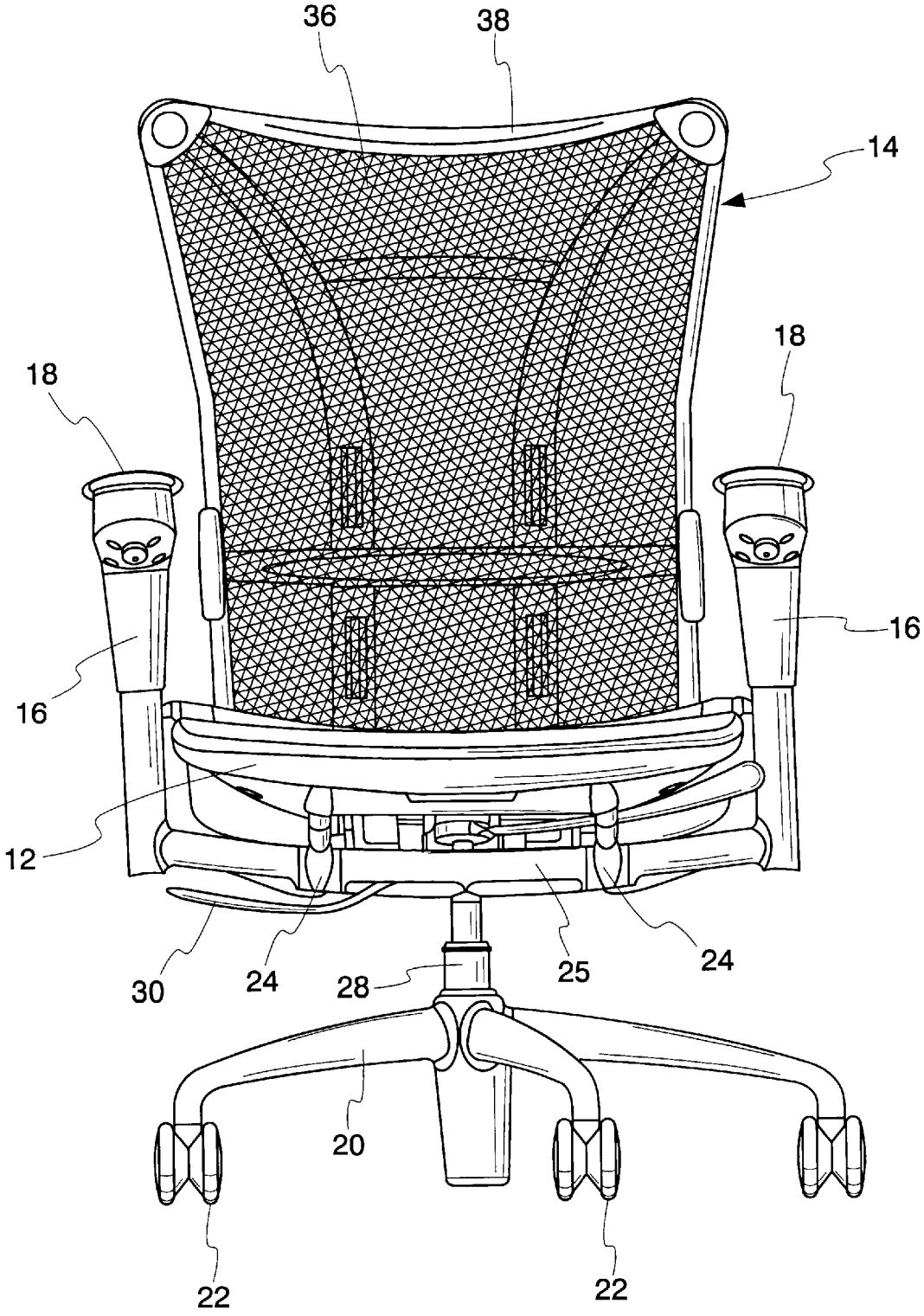
FIG. 5 is a front elevation view of the chair.
Figure 6:
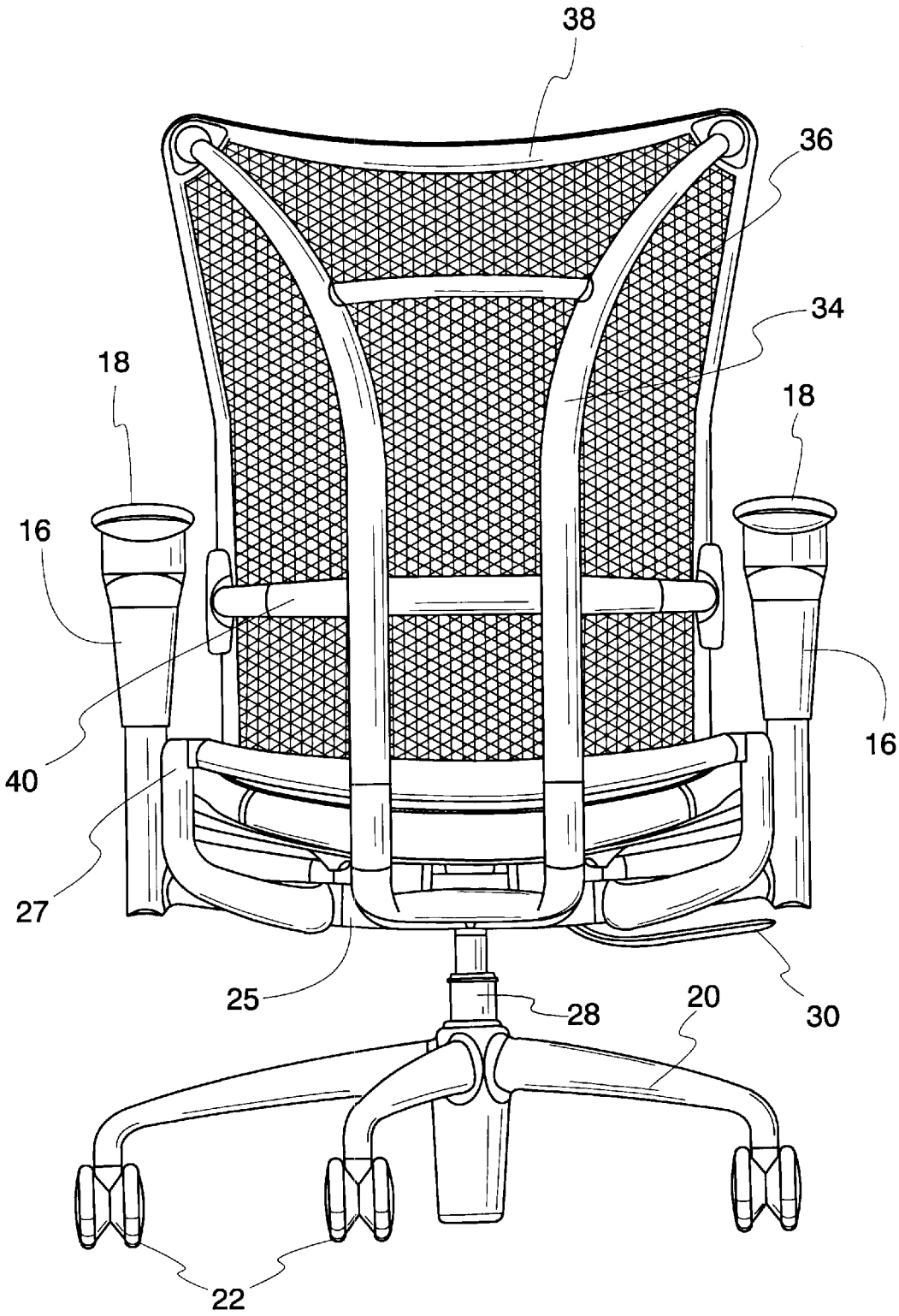
FIG. 6 is a rear elevation view of the chair.
Figure 7:
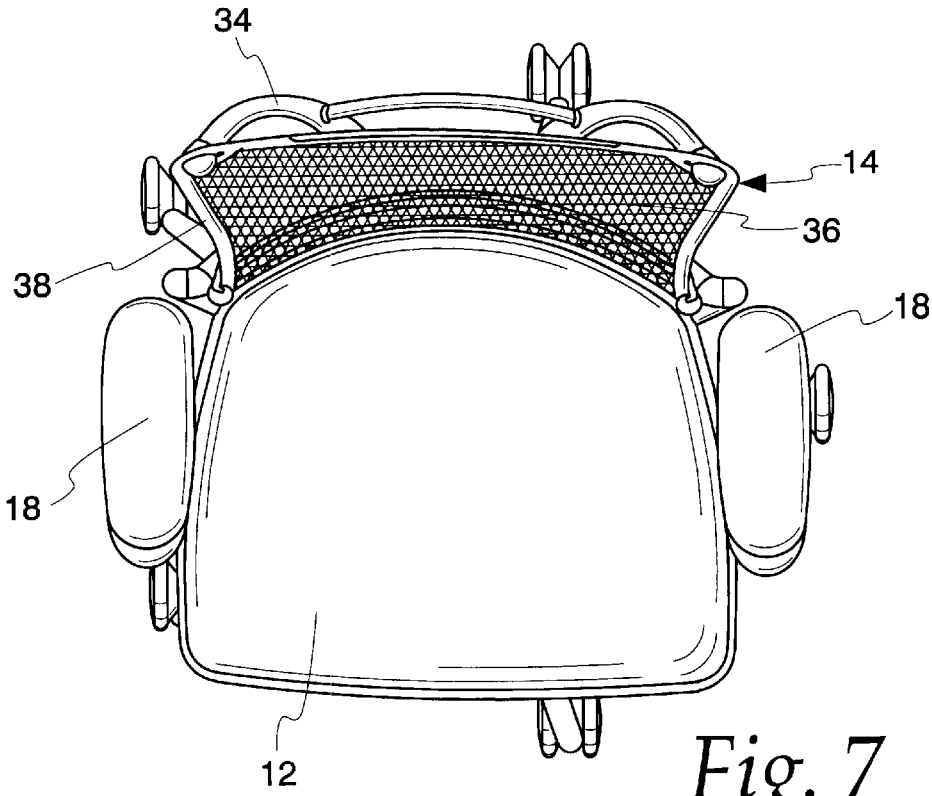
FIG. 7 is a top plan view of the chair.
Figure 8:
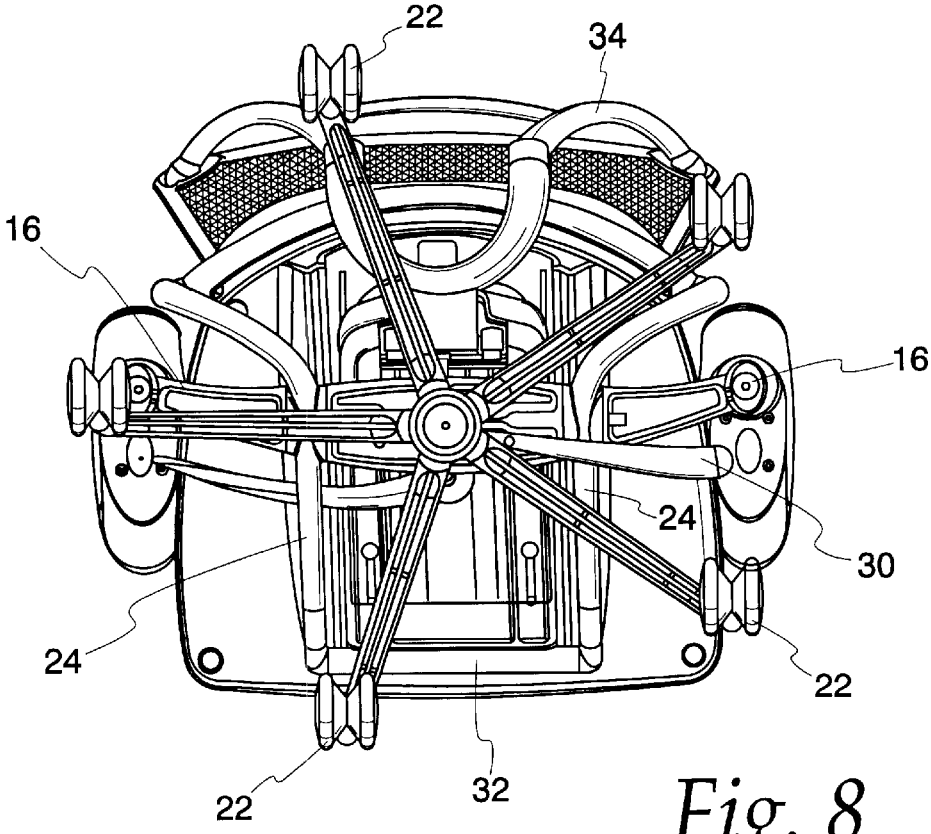
FIG. 8 is a bottom plan view of the chair.
Figure 9:
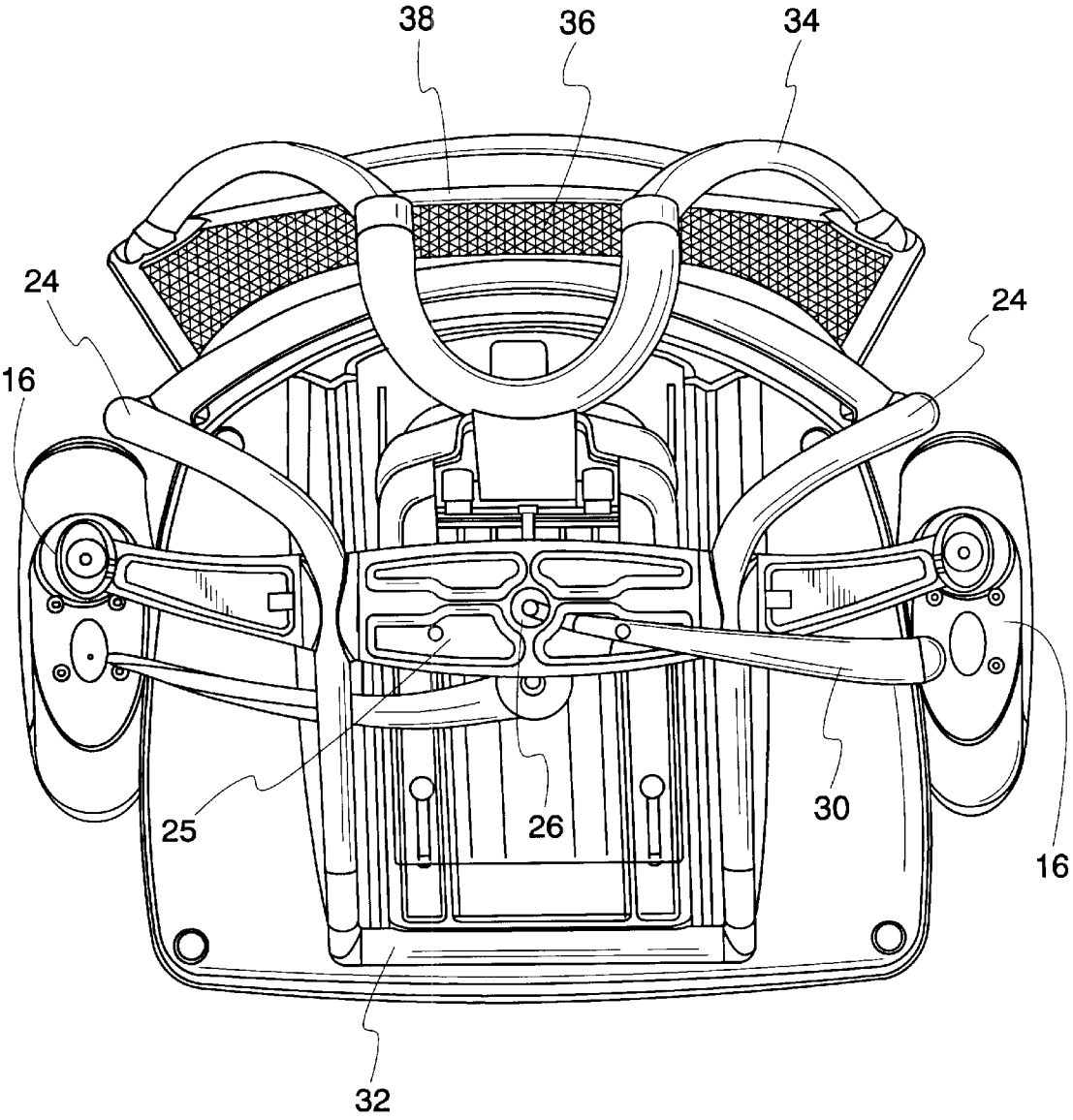
FIG. 9 is a bottom plan view of the chair with the chair base removed.
Figure 9A:
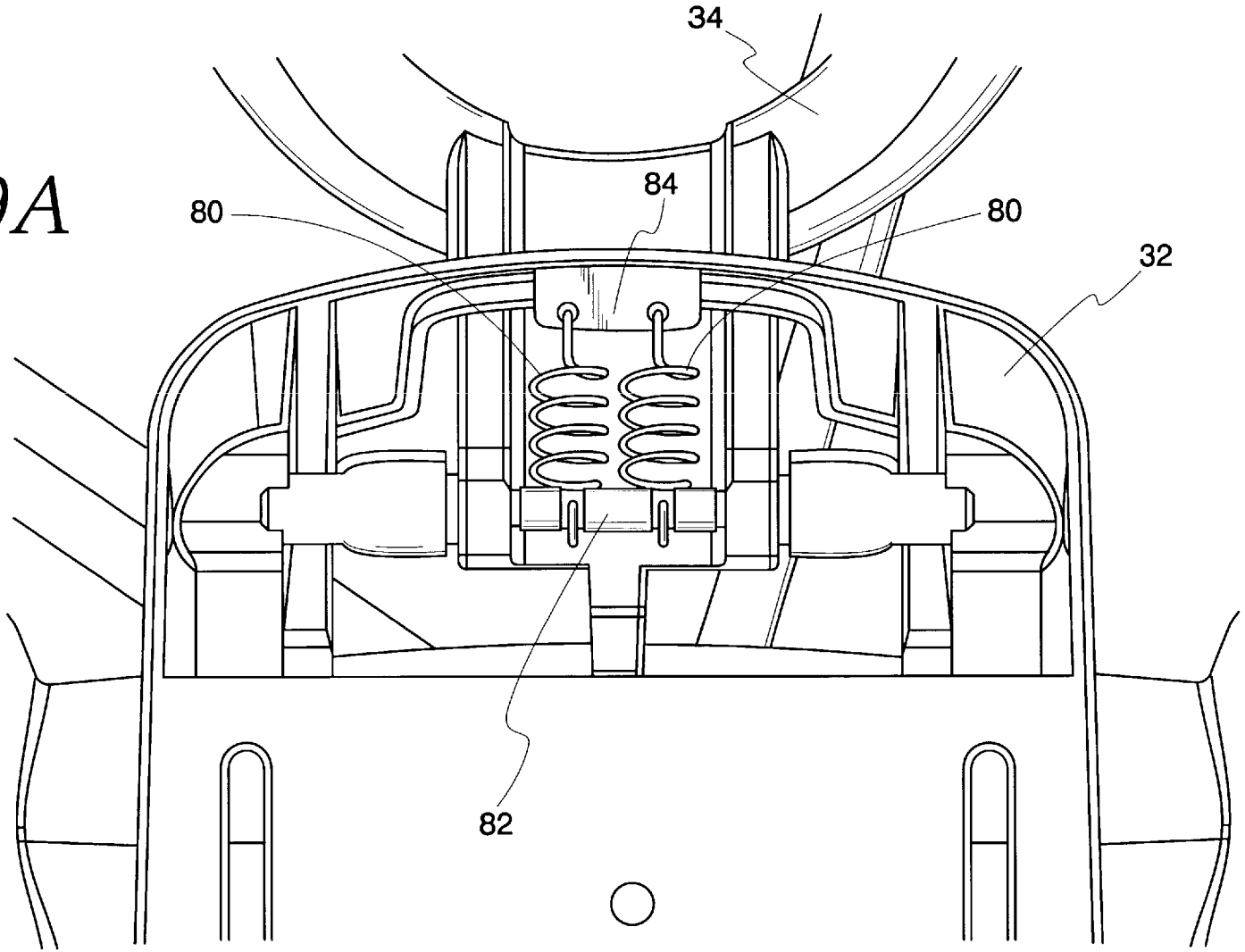
FIG. 9A is a bottom plan view of the chair without a central support module.
Figure 10:
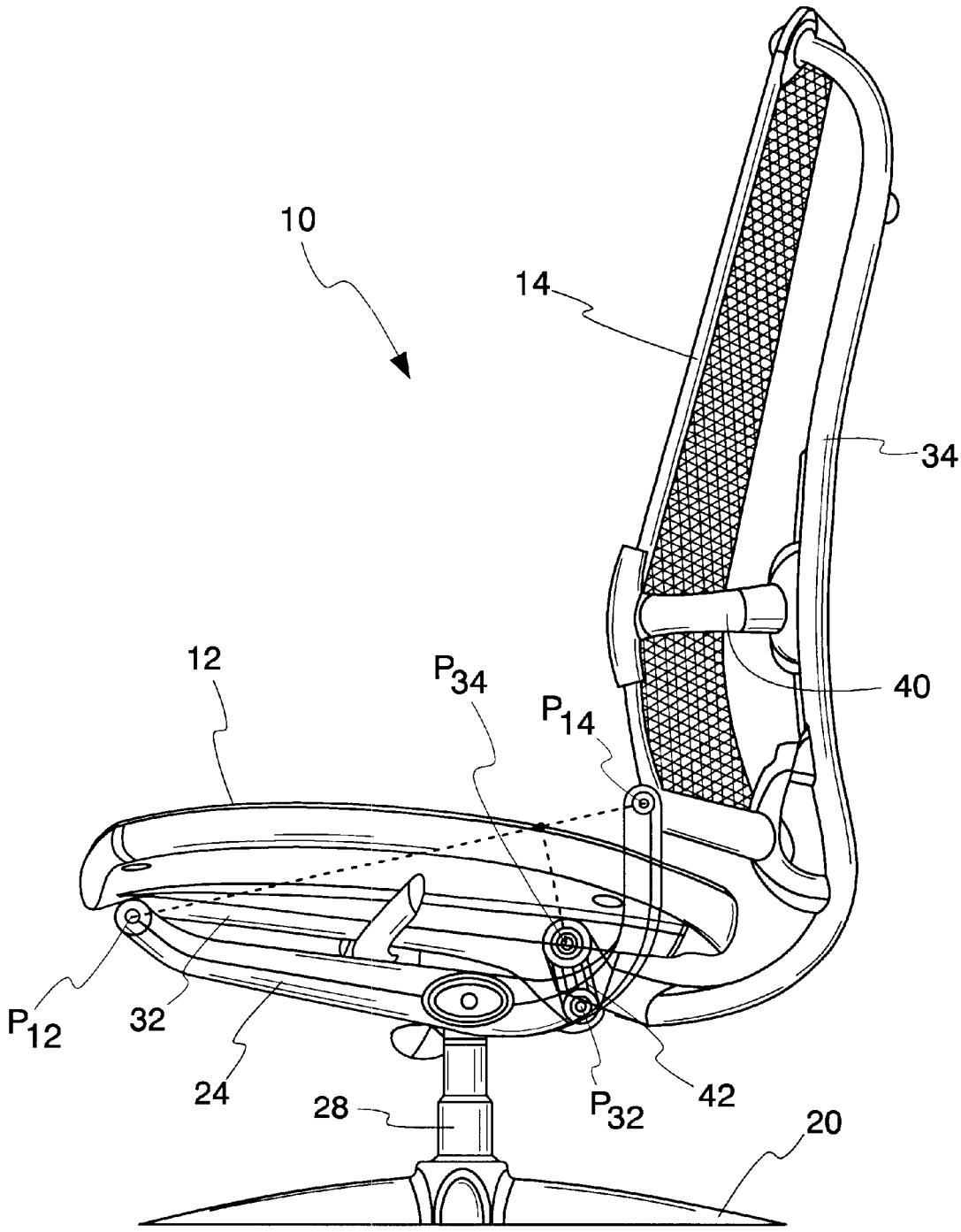
FIG. 10 is a partial left elevation view illustrating the chair in a fully upright position.
Figure 10A:
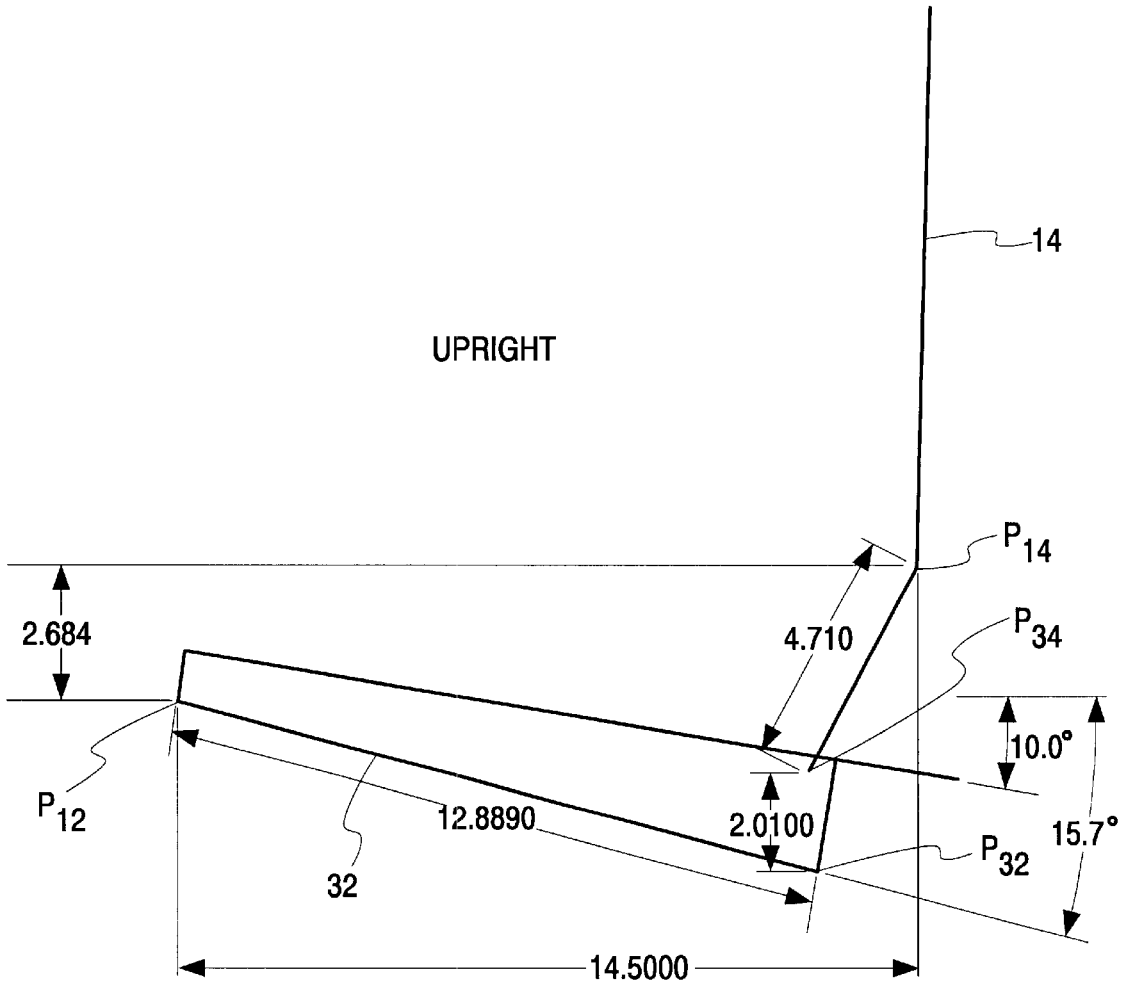
FIG. 10*a* is a diagrammatic elevation view of the chair illustrating pivot points.
Figure 11:
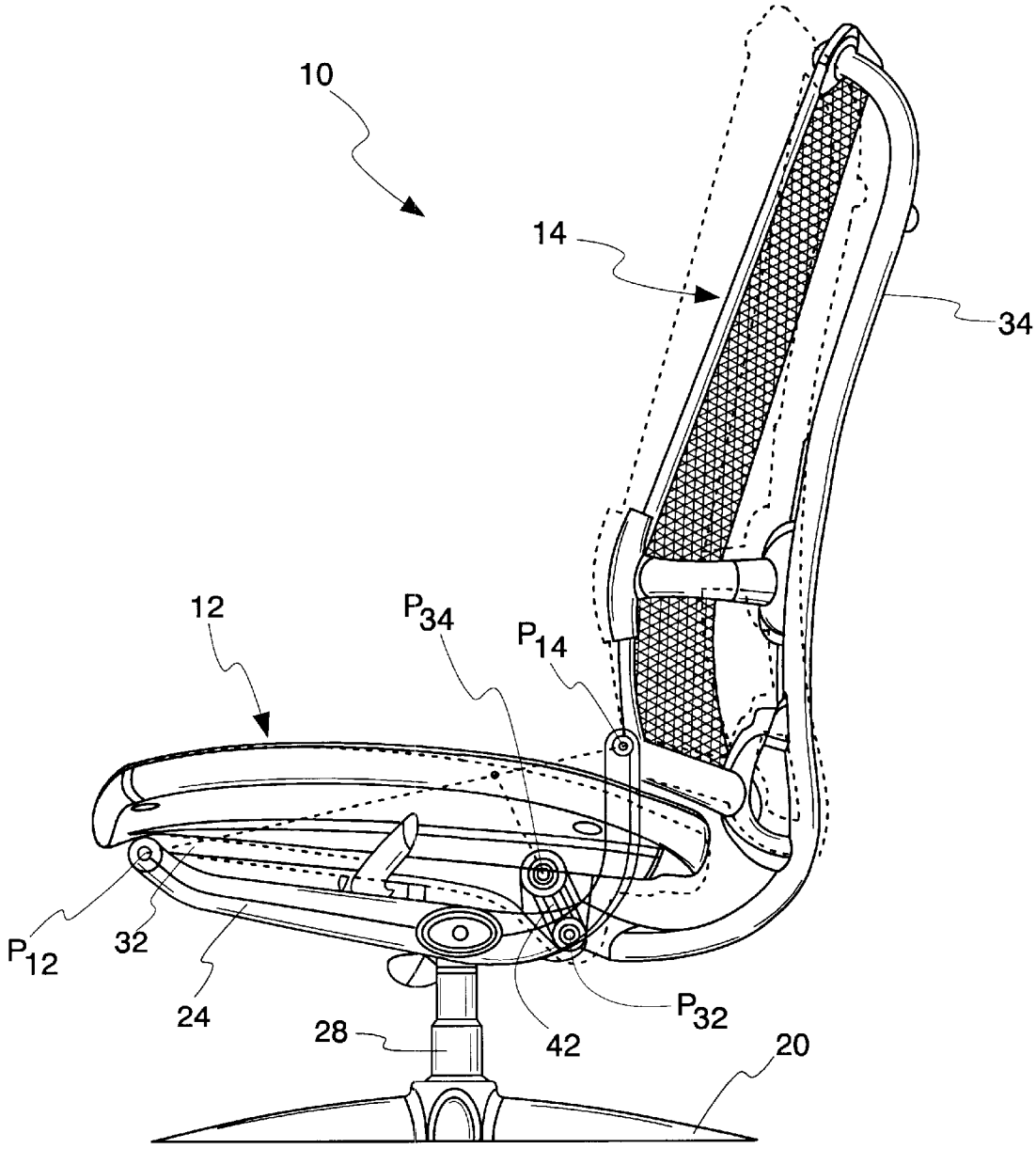
FIG. 11 is a partial left elevation view of the chair shown in a partially reclined position.
Figure 12:
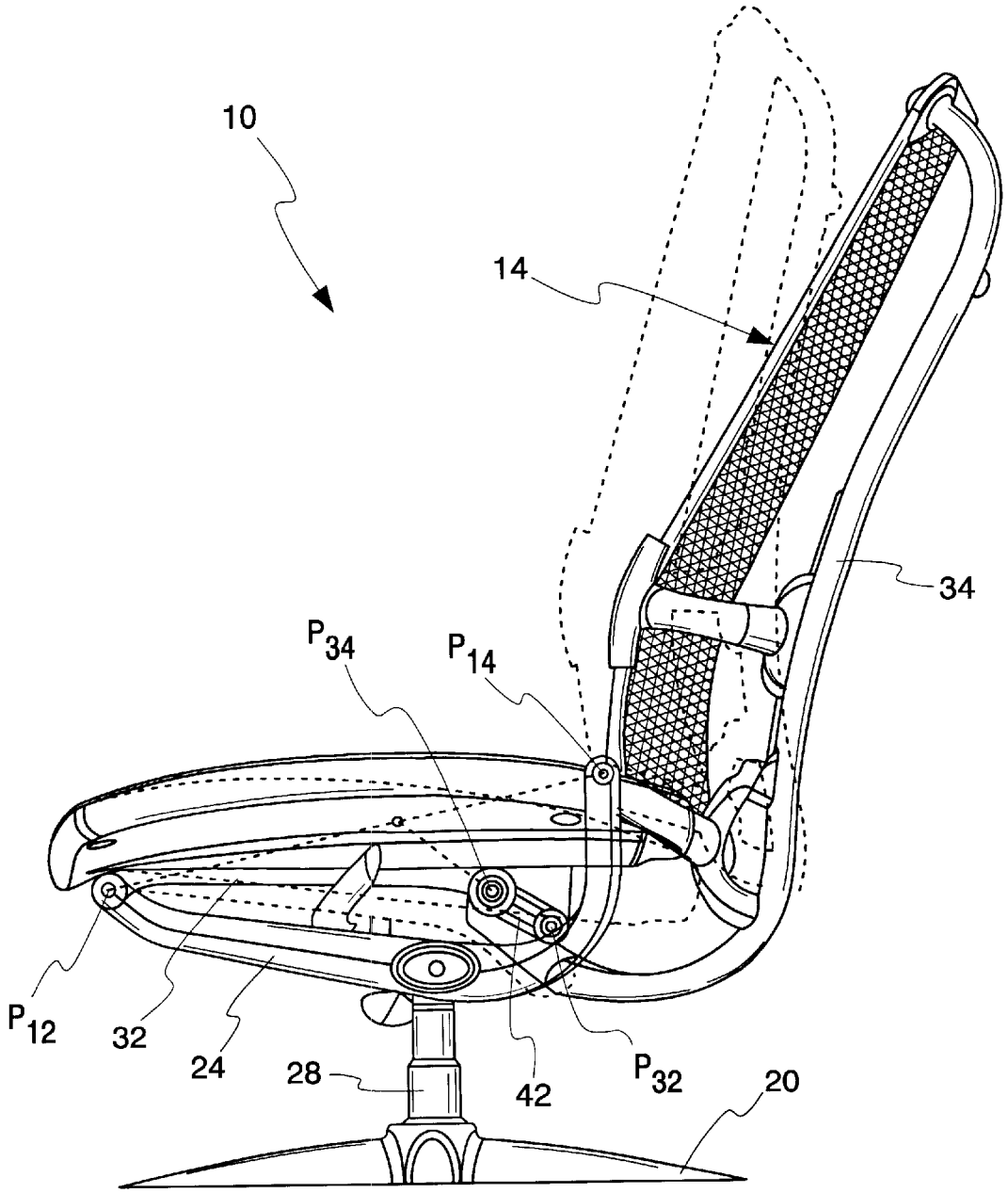
FIG. 12 is a partial left elevation view of the chair shown in a fully reclined position.
Figure 12A:
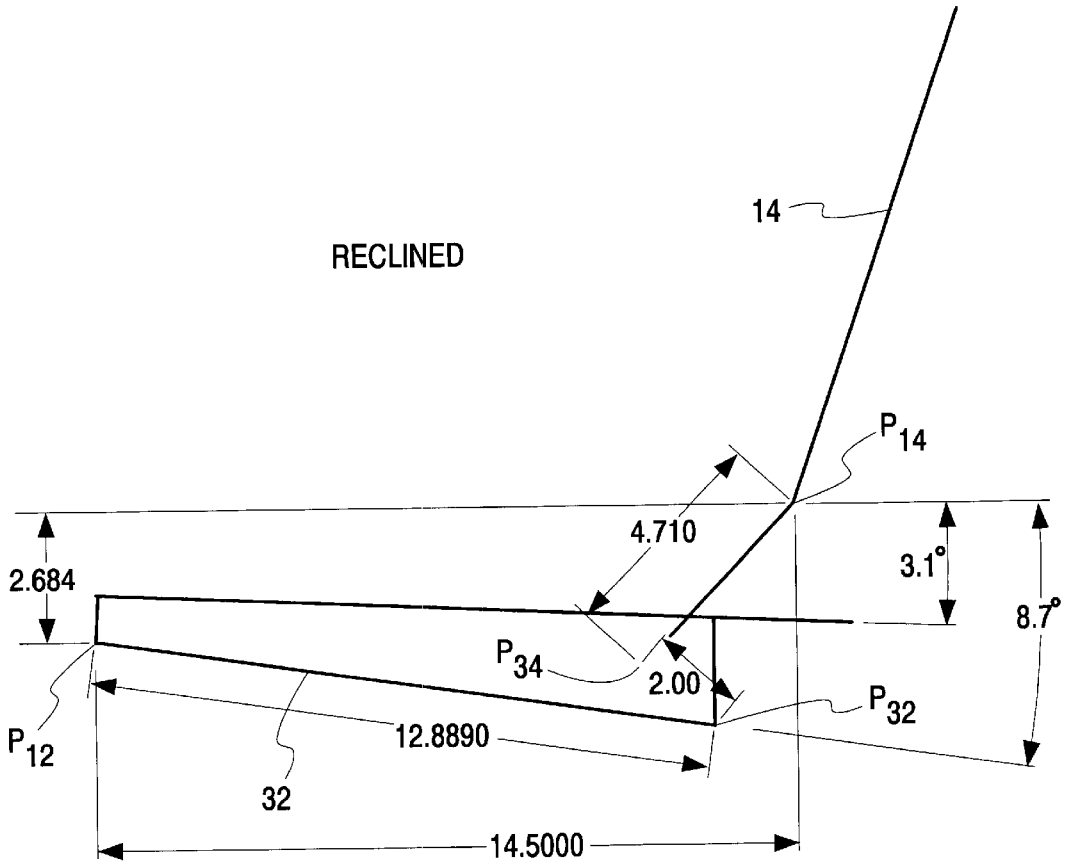
FIG. 12*a* is a diagrammatic elevation view of the chair showing the pivot points when in a reclined position.

Referring now to the drawings, and initially to FIGS. 1, 2 and 2A, an improved ergonomic chair is shown in front isometric view and designated generally by the reference numeral 10. The chair 10 comprises as its principal components a seat 12 and a back 14. Suitable arms 16 having upper pads 18 may be provided. The chair 10, in a conventional manner, may be supported on a spider base 20 movable on casters 22.

As shown in FIGS. 3–9, the chair 10 is so constructed as to have synchronous movement of the seat 12 and the back 14. To this end, a pair of main seat and back supports 24 are rigidly attached to a central support module 25 having a hub 26 for frictionally receiving an upper end of a gas cylinder 28. The gas cylinder 28 is preferably a two-stage type available from Stabilus GmbH of Germany. This cylinder 28 is operable by a manually pivotable lever 30 which activates the cylinder 28 for height and adjustability of the chair 10 in a manner well-known in the art. The chair arms 16 are rigidly connected to the supports 24. A seat pan 32 is pivotably connected at its front end to the forward end of the supports 24. A support back frame assembly 34 is also pivotably connected to the upper rear 27 of the supports 24. The chair back 14 comprises a stretchable fabric mesh 36 supported around its periphery by a deformable, resilient and stretchable carrier 38. An adjustable lumbar support member 40 slidably connects to the carrier and bears against the back support assembly 34.

The relative portions of the seat 12 and the back 14 of the chair 10, during reclining of the back 14, can be seen in the side views of FIGS. 10, 10*a*, 11, 12 and 12*a*. As illustrated in these views, the chair seat pan 32 is pivotably connected at pivot points $P_{12}$ to the supports 24 (only one of which can be seen) and is pivotably connected at rear pivot points $P_{32}$ to a pair of links 42 (only one of which can be seen). Each link 42 in turn is pivotably connected at point $P_{34}$ to forward extensions 33 of the back frame assembly 34. The back frame assembly 34 is also pivotably connected at point $P_{14}$ to the upper rear end portions 27 of the two supports 24. As shown in the three stages of back tilt illustrated in FIGS. 10–12, as the back 14 reclines rearwardly, the link 42 moves in a counterclockwise direction of rotation causing the rear of the seat pan 32 to elevate relative to its front. This synchronous motion of the seat pan 32 and back 14 provides for an exceptionally comfortable reclining motion of the chair 10 user to aid in avoiding fatigue as the user is performing various work-related tasks.

Figure 13:
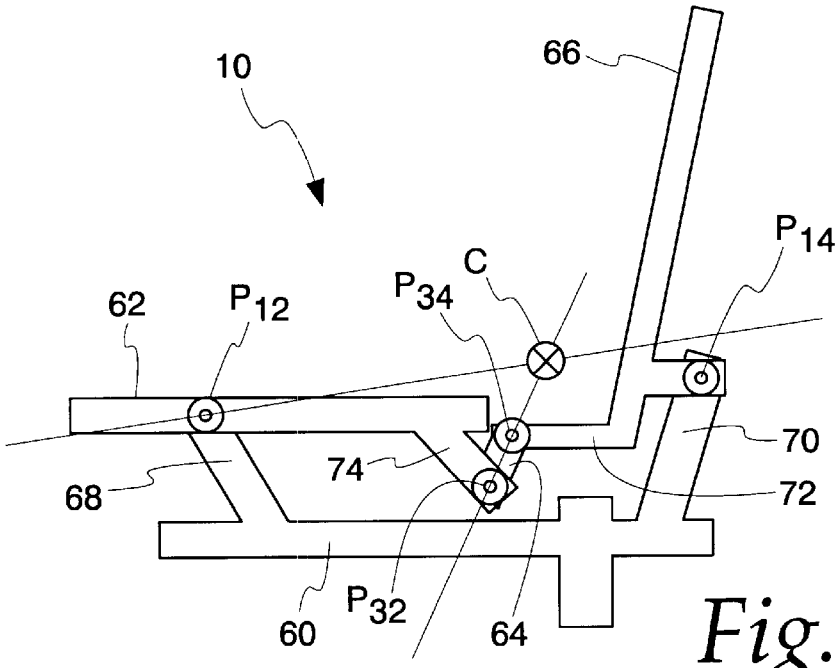
FIG. 13 is a side schematic view showing the linkage arrangement of the chair.
Figure 14:
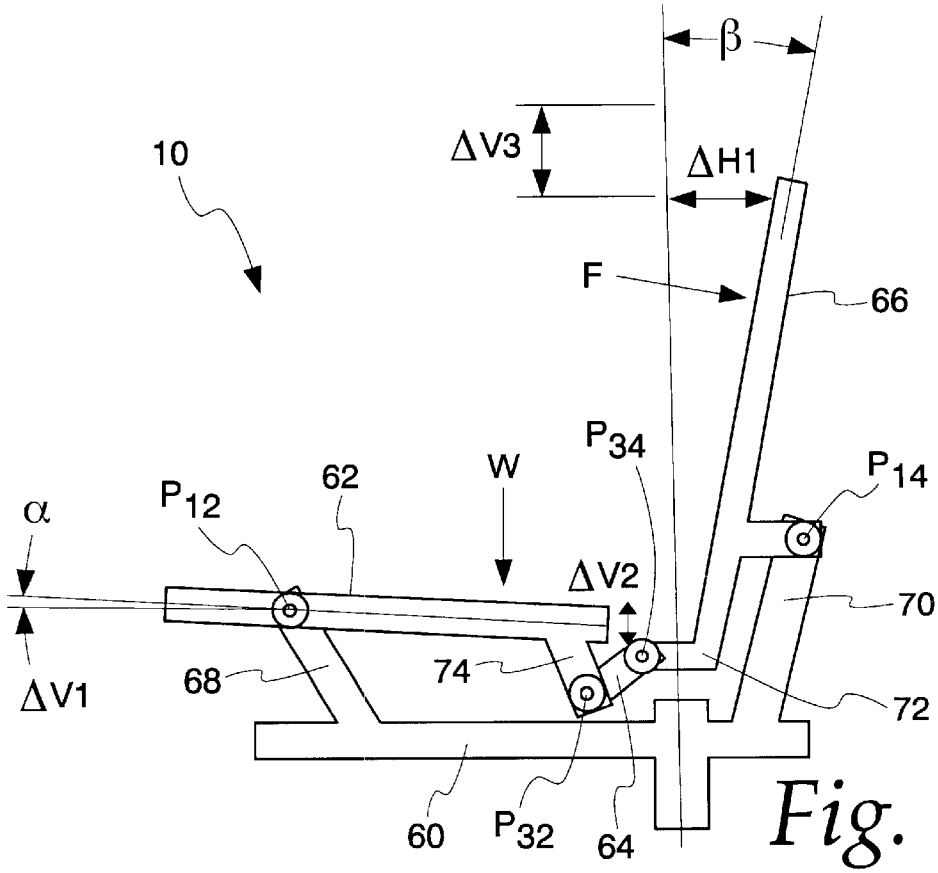
FIG. 14 is a side schematic view showing the kinematics of the chair.

Shown now in FIGS. 13 and 14 are schematic views of the synchronous seat and back tilt feature employing a four-bar mechanism which allows the rear of the seat to elevate as the backrest is reclined. The mechanism is designed to immediately respond to a user exerting a back force and/or self-weight on the seat. This function allows for reclining of the chair 10 about a rotation point C that is very closely coincident with the pivot axis of the user's hips and avoids undesirable "shirt pull" of the user. Because the rear of the seat is elevated during back reclining, excess pressure is relieved at the front underside of the user's thighs, and also a relatively constant gaze angle is maintained during reclining. This provides for adequate fluid circulation in the user's legs and avoids swelling. To accomplish the foregoing advantages, the chair 10 comprises four basic members and four rotationally-free pivots. The basic members include a floor supported member 60, a seat rest 62, a linking member 64 and a backrest 66. The floor supported member 60 has an upwardly directed portion 68 that terminates at an end defining pivot point $P_{12}$ to which the seat rest 62 is pivotably connected at its forward portion. The member 60 also has an upwardly directed portion 70 which terminates at an end defining pivot point $P_{14}$ to which the backrest 66 is pivotably connected. A lower portion 72 of the back rest 66 is pivotably connected at point $P_{34}$ to the linking member 64 and a downwardly extending portion 74 of the seat rest 62 is pivotably connected at point $P_{32}$ to the other end of the linking member 64.

The kinematics of the chair 10 are illustrated in FIG. 14. As force F is applied on the backrest 66, the back tilt angle $\beta$ increases, eye location shifts backwards an amount $\Delta H1$, and eye elevation decreases by an amount $\Delta V3$. The change in back tilt angle $\beta$ transmits motion by way of the upper and lower back pivots $P_{14}$ and $P_{34}$, respectively, to the linking member 64. As a result of motion set in linking member 64, the rear seat pivot $P_{32}$ moves in coordination with pivot $P_{34}$ in a composite rotational and translation motion. As the seat rest 62 rotates about pivot $P_{12}$, a lift $\Delta V2$ is caused in the rear part of the seat rest 62 relative to its front edge $\Delta V1$ in the amount $\Delta V2-\Delta V1$, therefore introducing a seat rest angle $\alpha$. The user sitting in the chair will feel a weight reduction effect as a result of the lift. The apparent weight reduction will be sensed as lightness and give the feel of comfort.

It can now be appreciated that the chair 10 offers considerable advantages in user comfort by virtue of its synchronous linkage construction particularly where it is used for prolonged periods of time. The chair 10 is also cost effective to manufacture and assemble.

Figure 15:
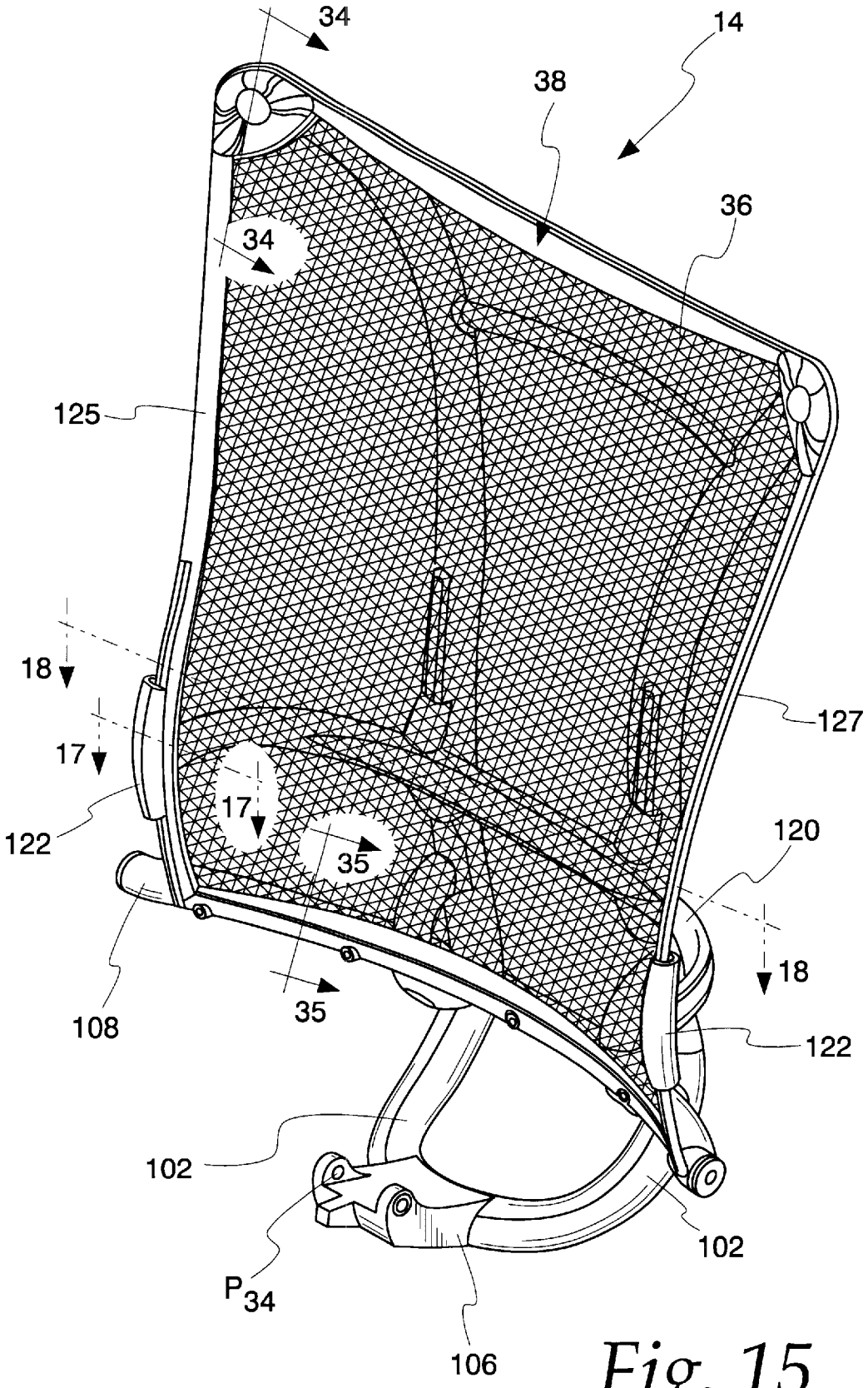
FIG. 15 is a front isometric view of the chair back assembly.
Figure 15A:
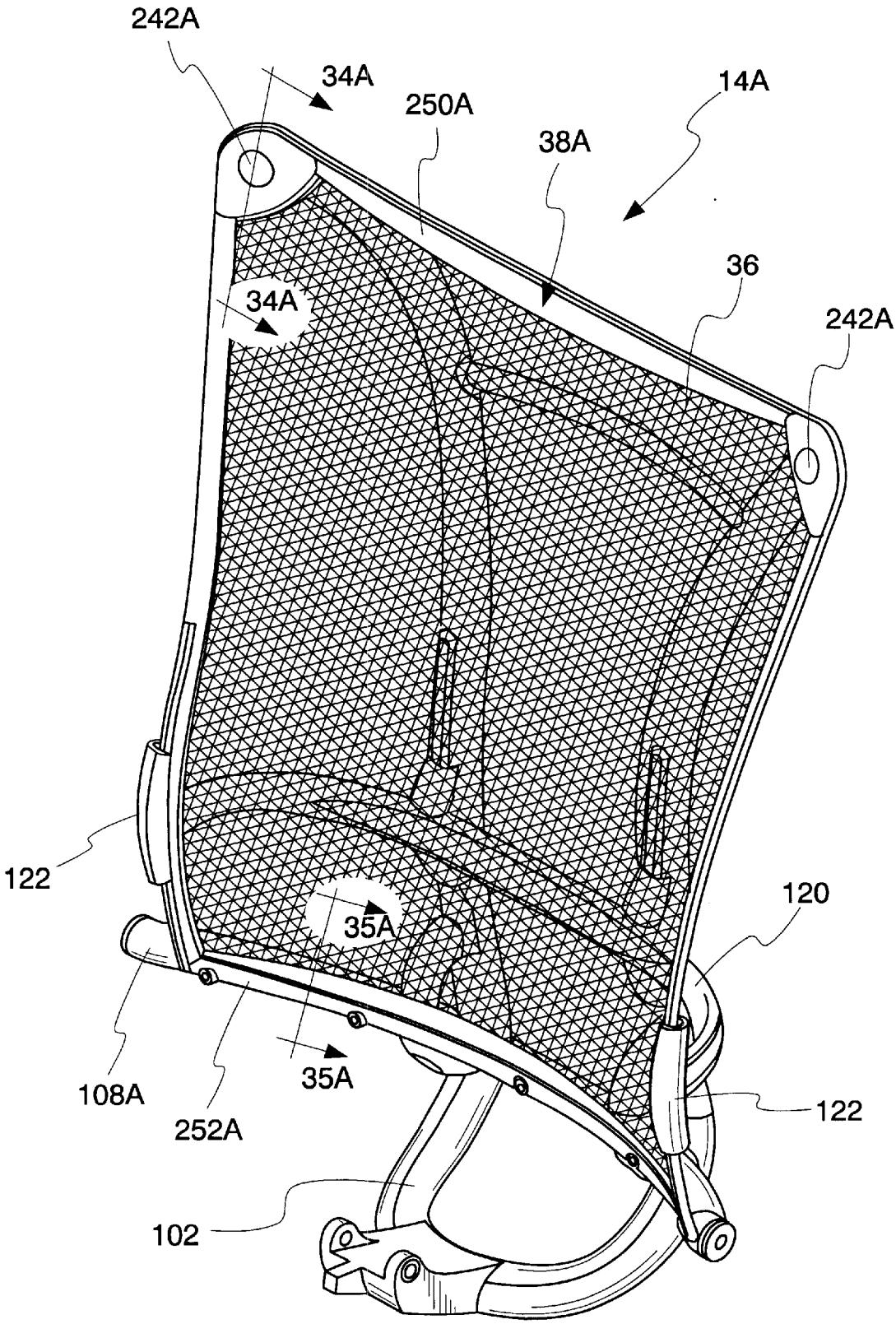
FIG. 15A is a front isometric view of another embodiment of the chair.
Figure 16:
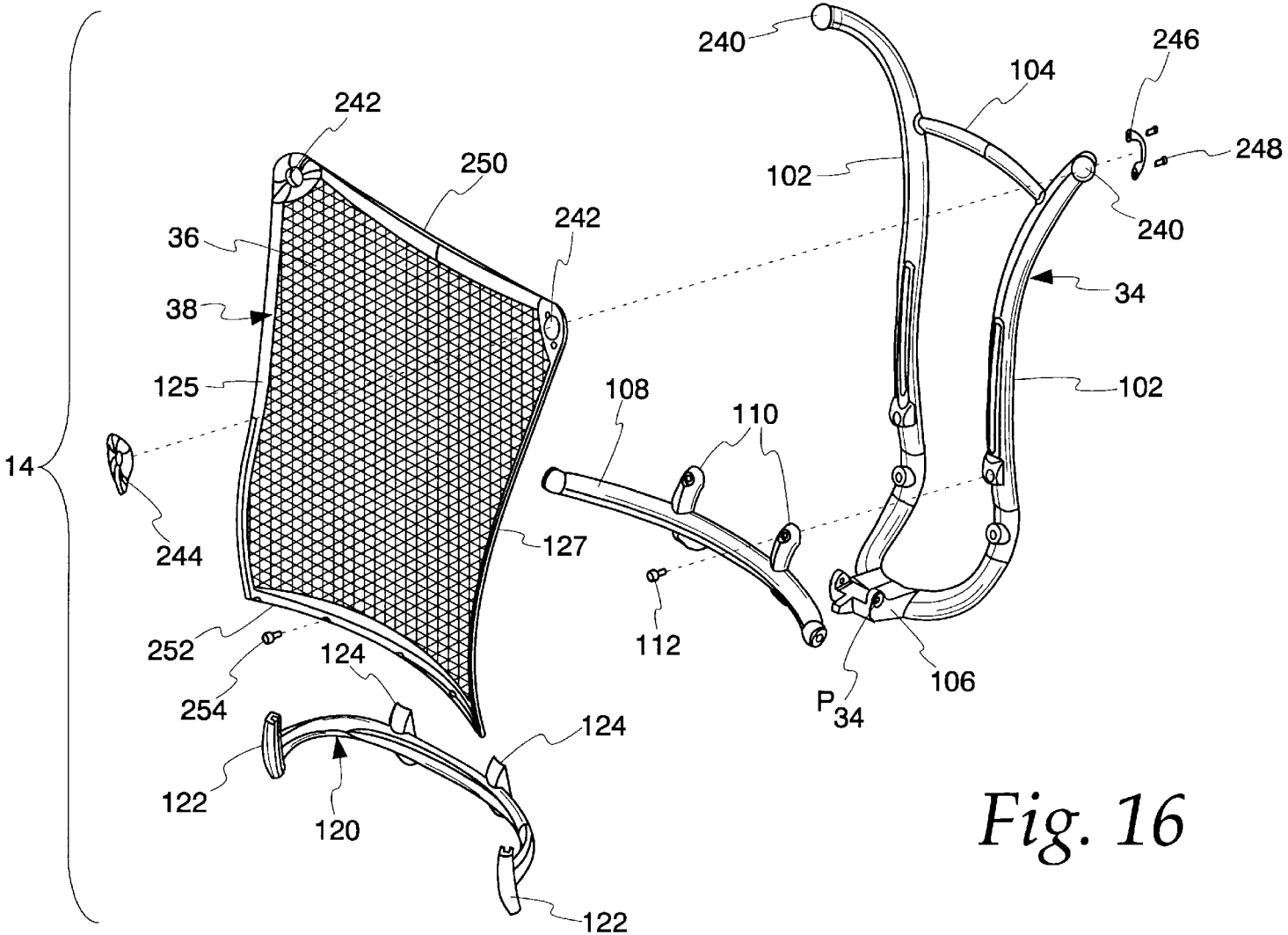
FIG. 16 is an exploded isometric view of the chair back assembly.
Figure 16A:
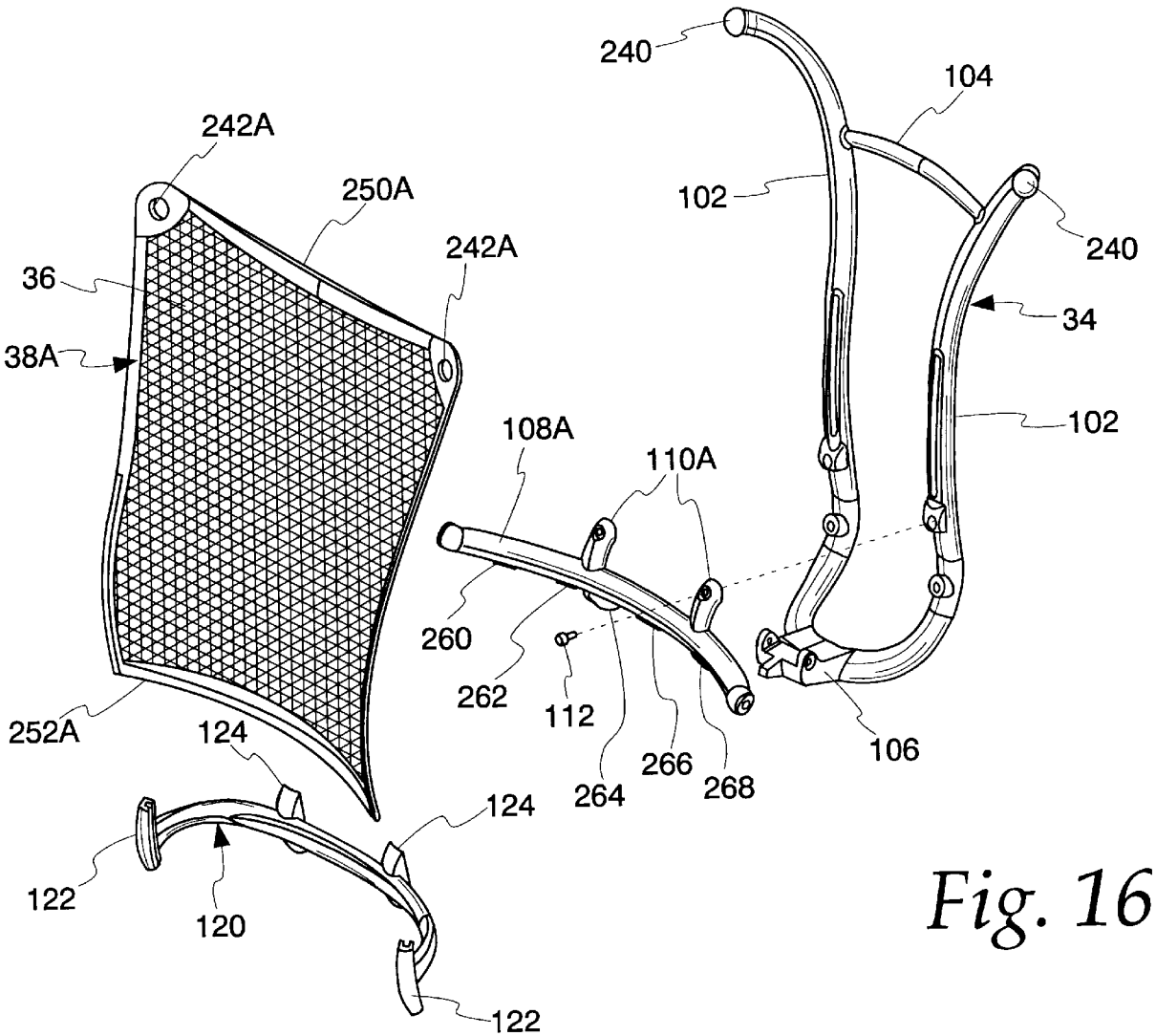
FIG. 16*a* is an exploded isometric view of another embodiment of the chair back assembly.
Figure 16B:
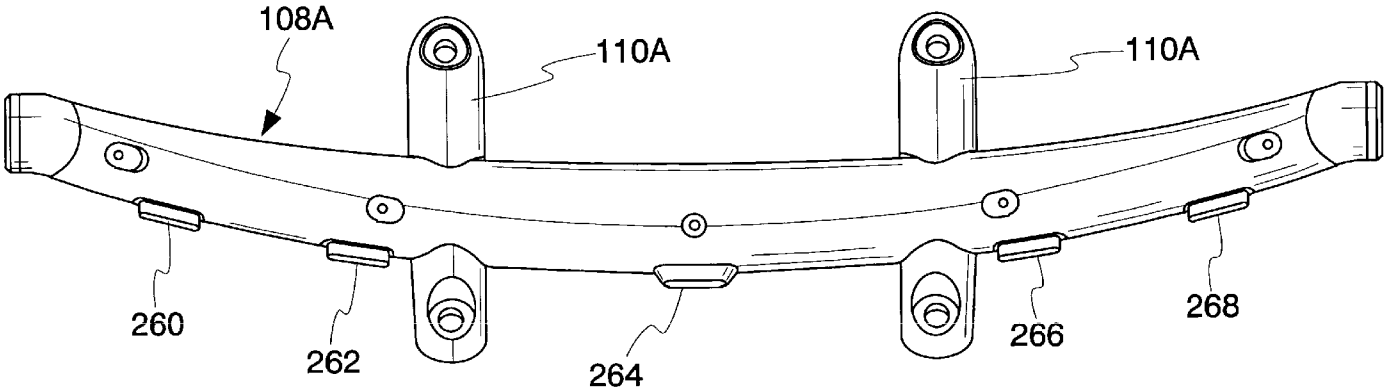
FIG. 16B is a front elevation view of a transverse member.
Figure 16C:
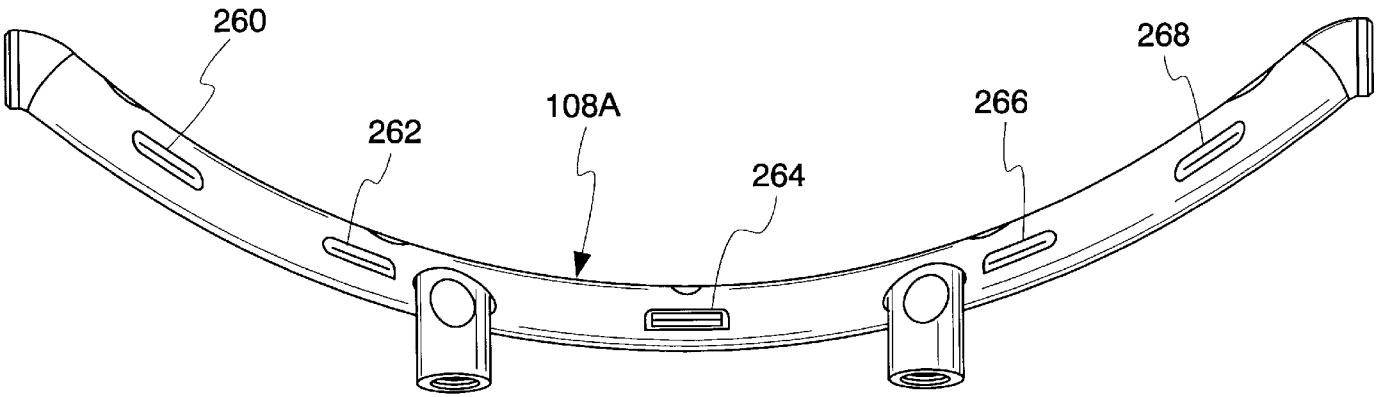
FIG. 16C is a bottom plan view of the transverse member.

Turning now to FIGS. 15 and 16, the complete back 14 of the chair is illustrated in perspective and shows the novel feature of the lumbar support construction. As earlier noted, the chair back 14 comprises a fabric mesh material 36 supported around its periphery by a semi-rigid bendable carrier 38. Main backframe member 34 includes two generally vertical supports 102 connected proximate their upper ends by a brace 104. The bottom ends of the supports 102 bend inwardly and terminate at a forwardly projecting member 106 which serves to provide aforementioned pivot point $P_{34}$. Transverse member 108 is provided with a pair of spaced arms 110 which are attached as by screws 112 to the two supports 102. The member 108 provides a lower attachment point for the carrier 38.

Figure 17:
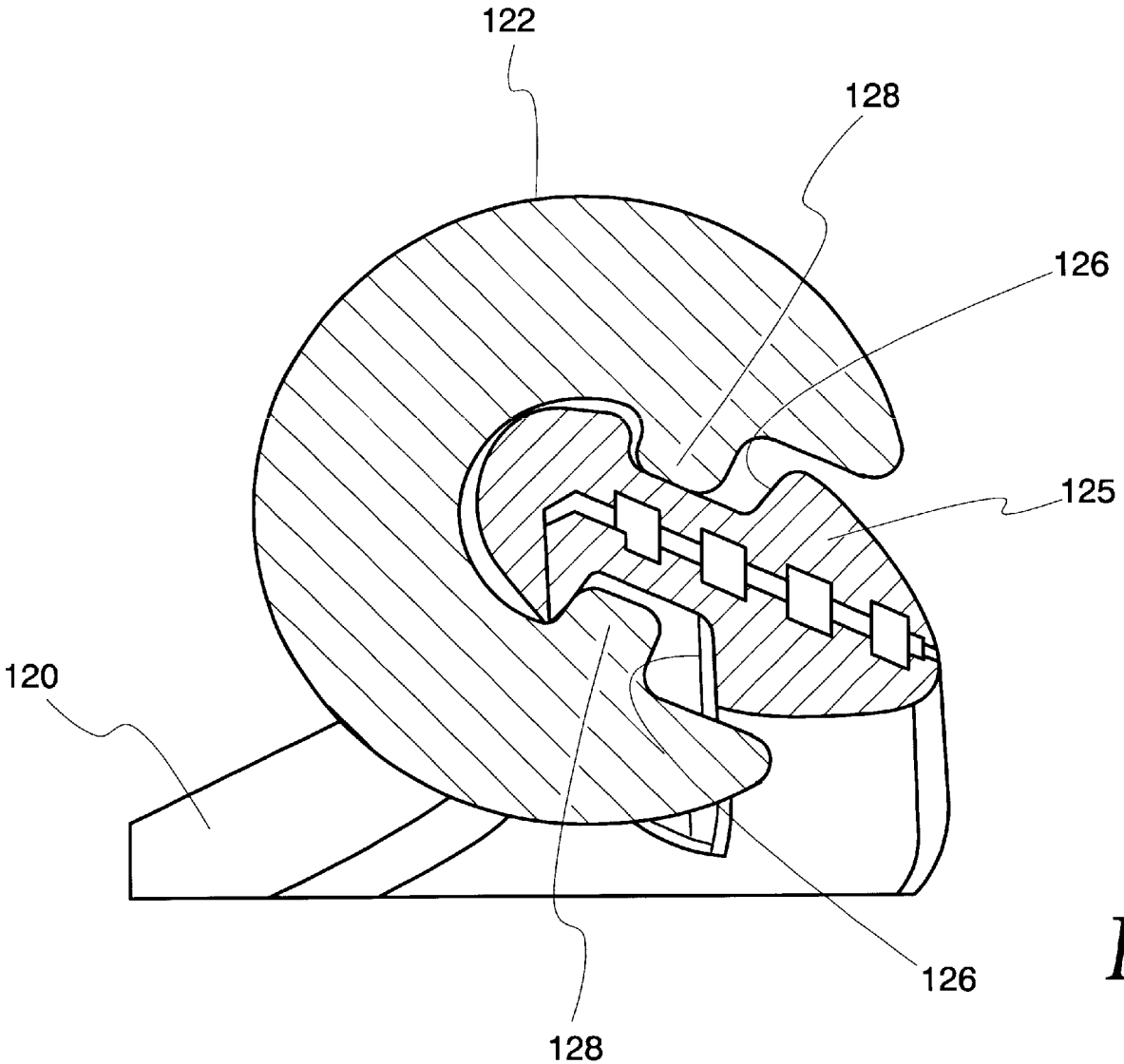
FIG. 17 is an enlarged cross-sectional view taken along the line 17—17 of FIG. 15.

In accordance with the invention the back assembly 14 includes a transverse lumbar support tube 120 having gripping means 122 on each of its opposed ends, together with a pair of spaced slide members 124. A cross-section of the gripping means 122 can be seen in FIG. 17 wherein the carrier 38 is provided with a pair of opposed recesses 126 in carrier side edges 125, 127 into which opposed projections 128 of the gripping means 122 are slideably received. Thus, the support tube 120 is slideable on opposed edges of the carrier 38.

Figure 19:
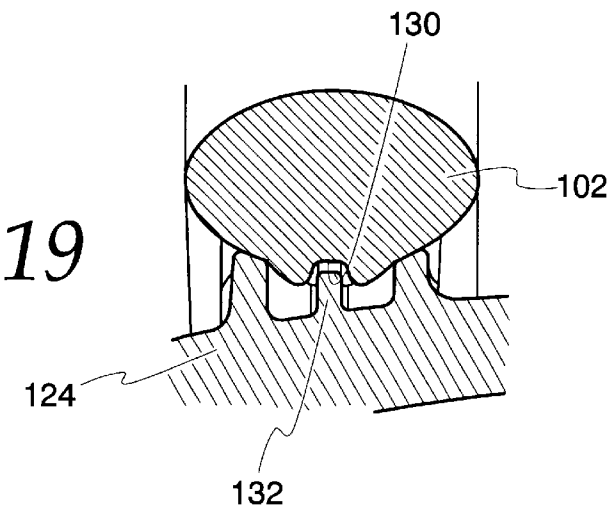
FIG. 19 is an enlarged cross-sectional view taken within the circle 19—19 of FIG. 18.
Figure 18:
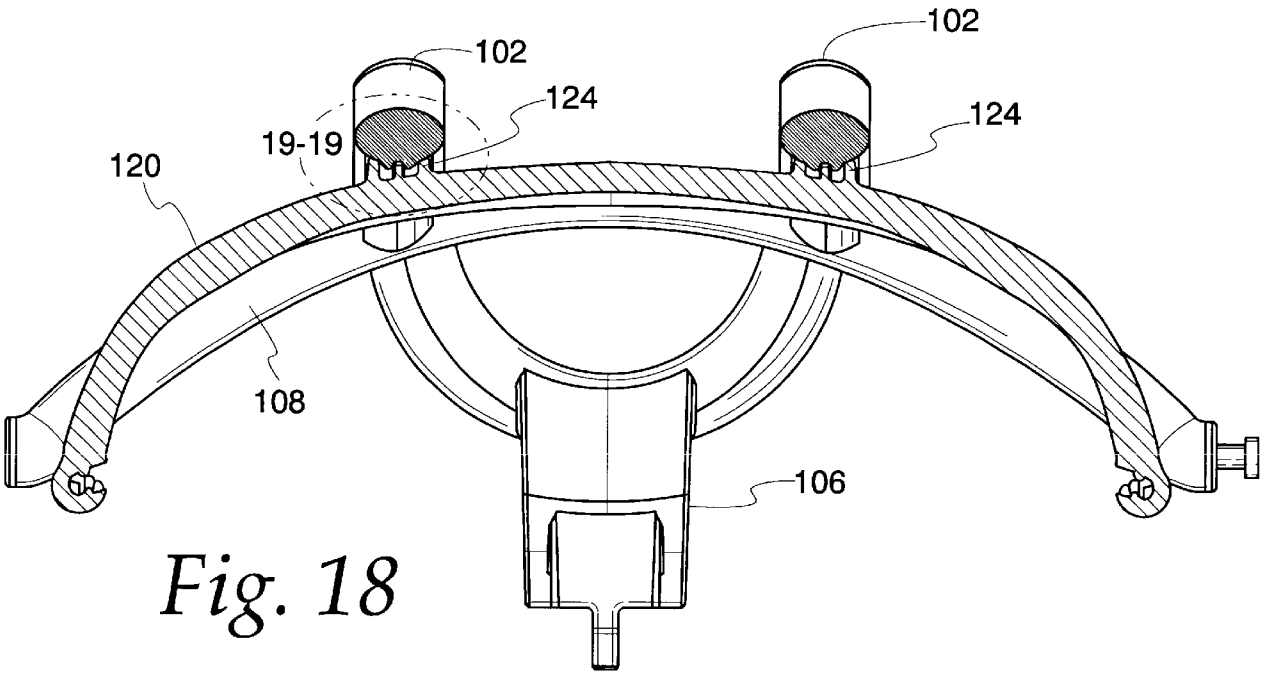
FIG. 18 is a cross-sectional view taken along the line 18—18 of FIG. 15.
Figure 20:
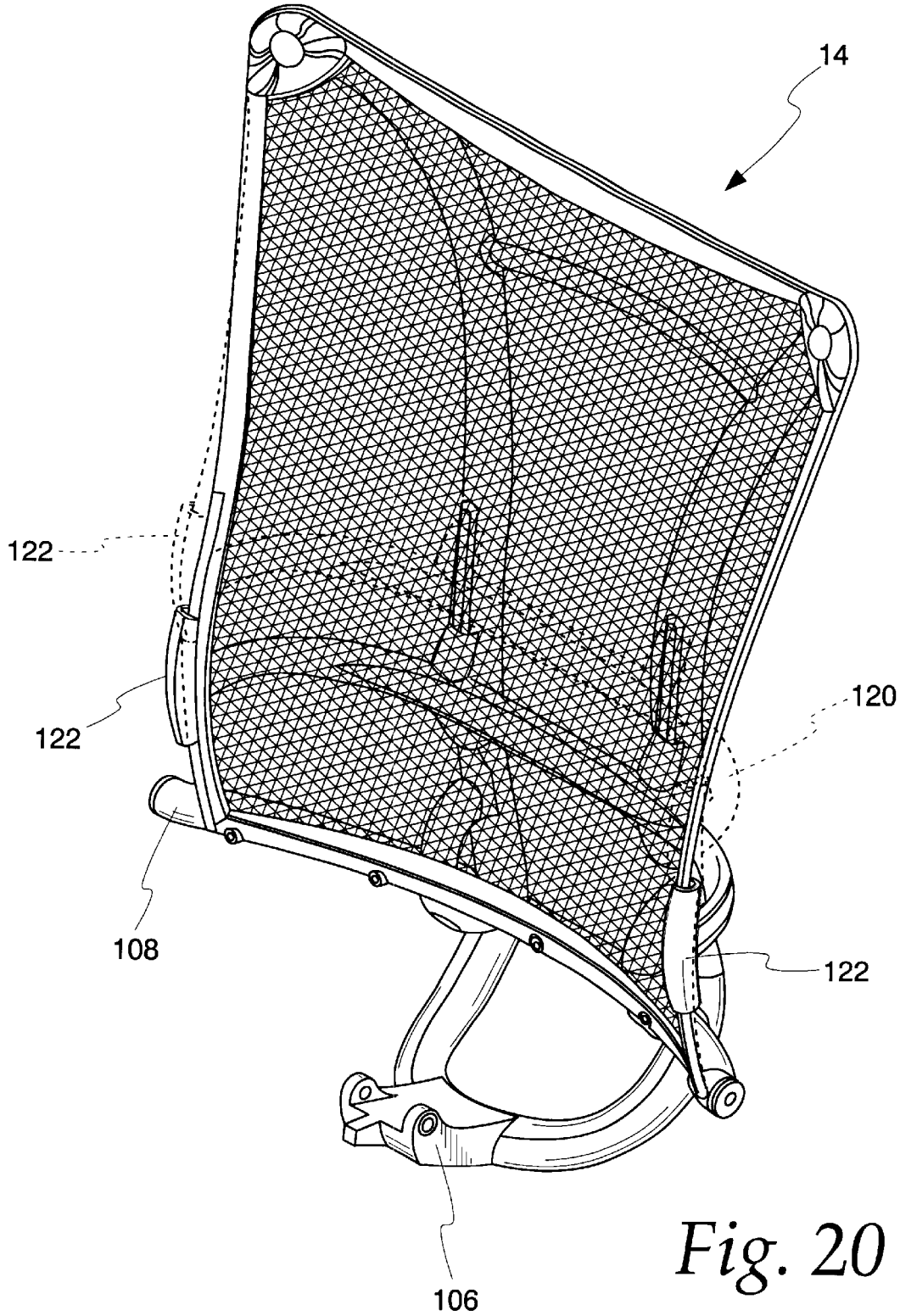
FIG. 20 is an isometric view of the chair back illustrating the adjustability of the lumbar support.

FIG. 18 illustrates a cross-sectional view of the support tube taken substantially along the line 18—18 of FIG. 15. There, it can be seen that the slide members 124 are configured to engage the vertical supports 102. As shown in FIG. 19, the engagement arrangement between each slide member 124 and the vertical supports 102 includes a vertical groove 130 in each support 102 and a corresponding central rib 132 extending from the slide member. It can now be appreciated, particularly with reference to FIG. 20, that the lumbar support tube 120 is vertically moveable between upper and lower positions as it slides on the edges 125, 127 of the carrier 38 by means of the gripping means 122 and also slides on the vertical supports 102 by means of the slide members 124. The result of such movement is to allow the chair user to adjust the vertical height of the tube 120 and thus the lumbar support by simple manual manipulation. The lumbar support tube 120 is held in proper connection to the supports 102 by just the tension of the carrier 38 and the mesh 36. In this tension mode the lumbar support tube 120 causes the carrier 38 and the mesh to be forced forwardly of the chair 10 in the lumbar region of the user. An advantage is that a user's back never touches the support tube or any hard surface.

The vertically adjustable lumbar support tube 120 changes the curvature of the carrier 38 as the support tube slides up and down between the carrier and the vertical supports 102. By changing the carrier's configuration, no high pressure contact regions are placed on a user's back. Instead, a taut but flexible mesh is positioned in contact with the user's back to comfortably support the user even as the chair reclines.

Figure 22:
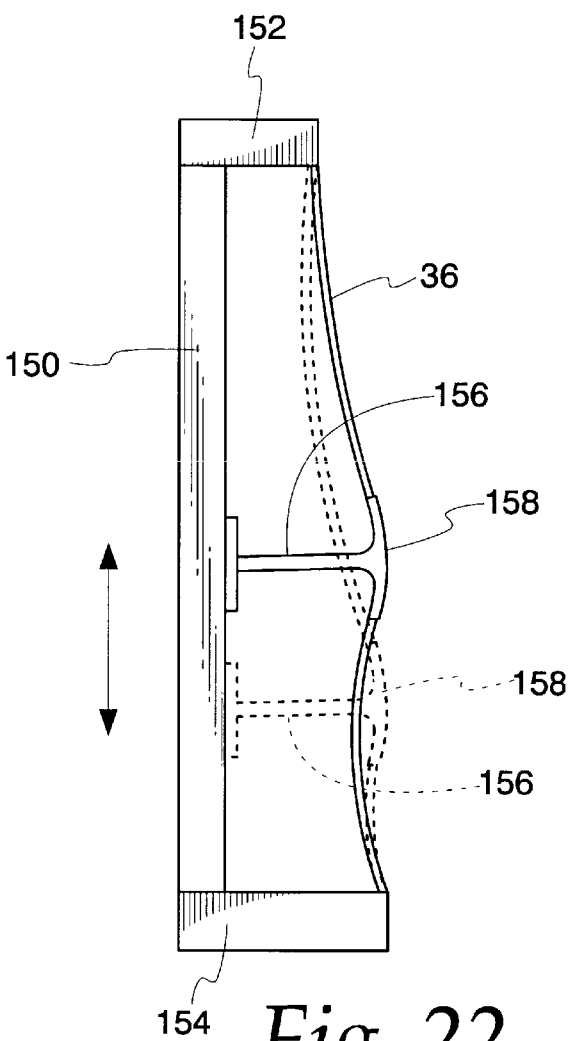
FIGS. 21–30 illustrate alternative constructions for the lumbar support.
Figure 21:
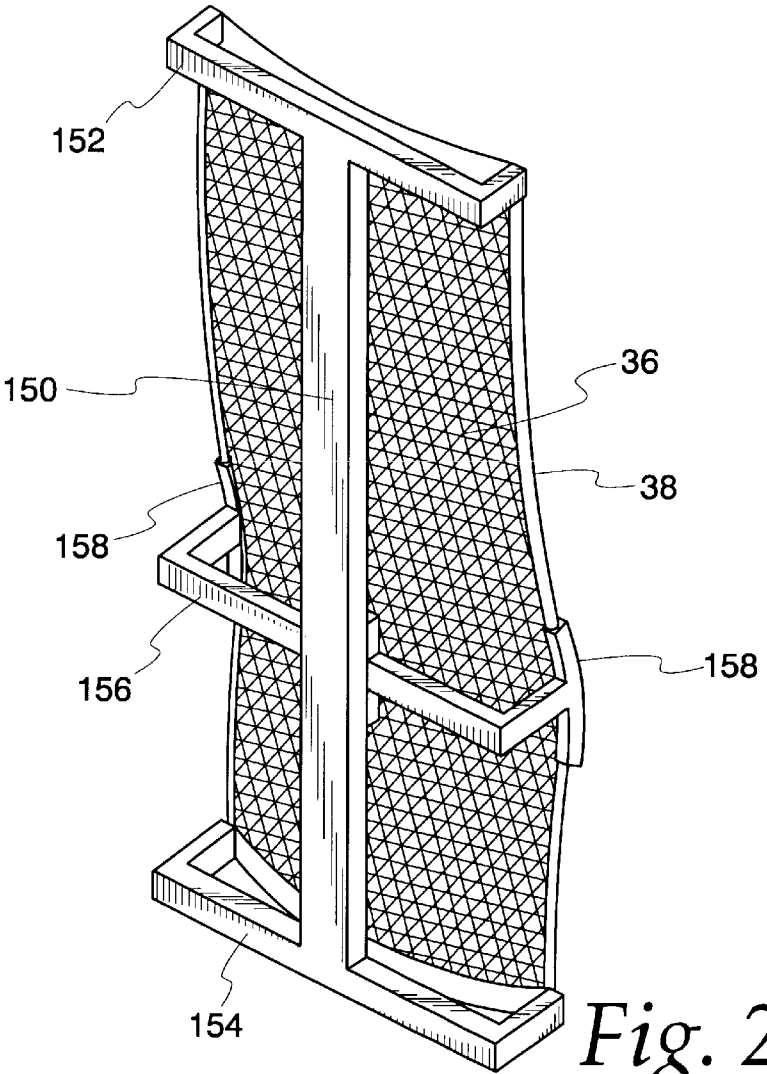

Alternative lumbar support systems using the mesh 36 and the carrier 38 assembly can be seen in FIGS. 21–30. In FIGS. 21 and 22, it can be seen that a single central support 150 may be employed having top and bottom braces, 152 and 154, respectively, to secure the four corners of the carrier. A lumbar support tube 156 may be slideably supported on the central support 150 and have gripping means 158 for slideably gripping opposed edges of the carrier 38.

Figure 24:
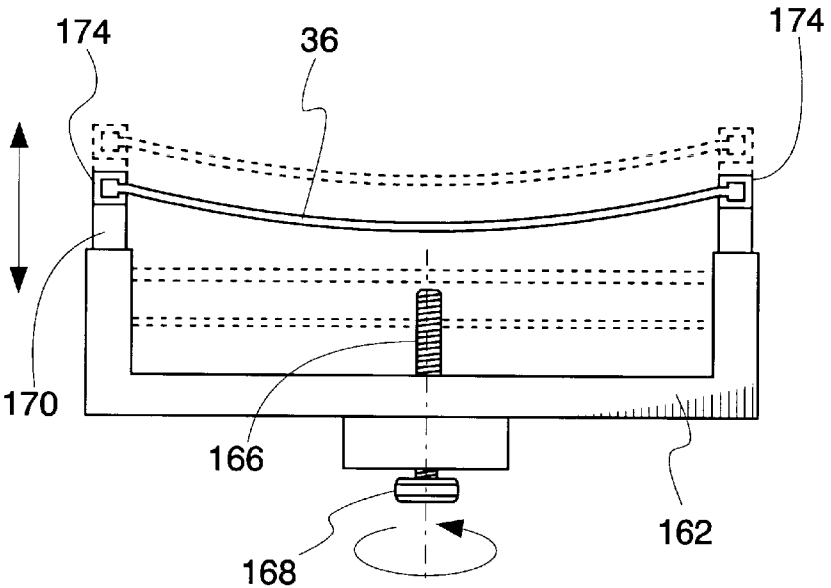
Figure 23:
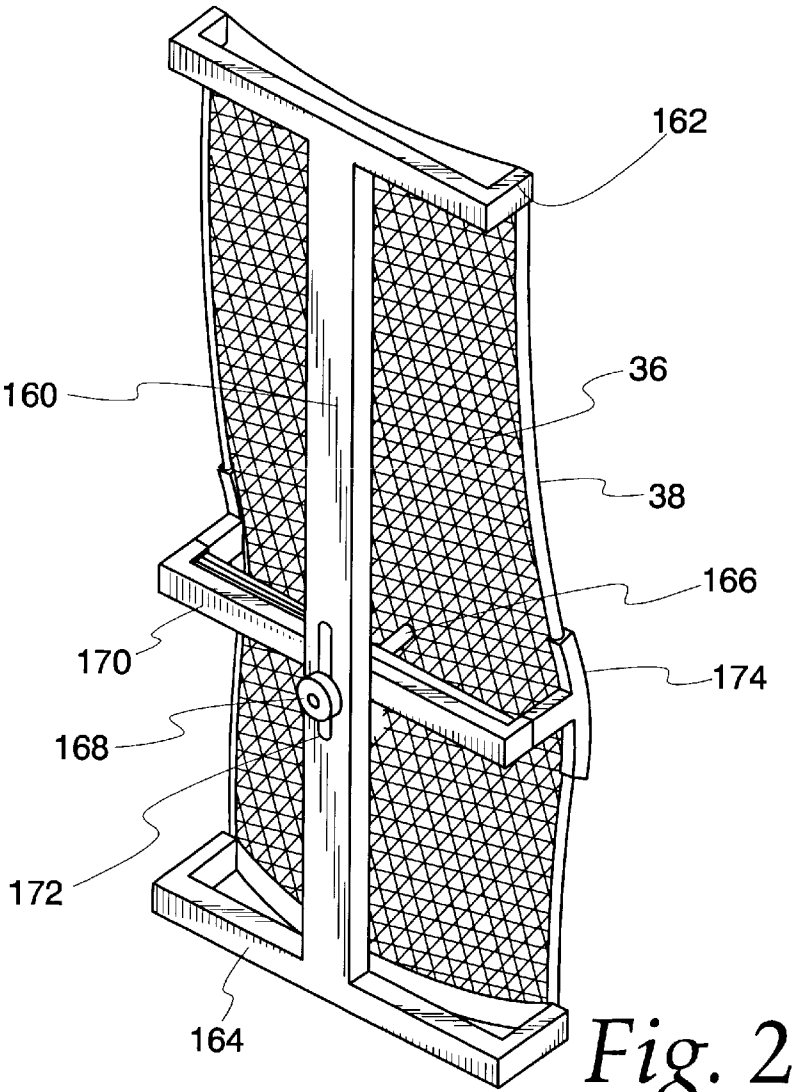

In FIGS. 23 and 24, a system is shown wherein a central support 160 and upper 162 and lower 164 braces react with a threaded rod 166 and a knob 168. The rod is employed to selectively move a lumbar support member 170 forwardly and rearwardly to adjust tension in the mesh 36. The system may also be constructed with a slot 172 through which the rod 166 passes to vertically adjust the member 170 as it slides on the carrier 38 using gripping means 174 as described above.

Figure 26:
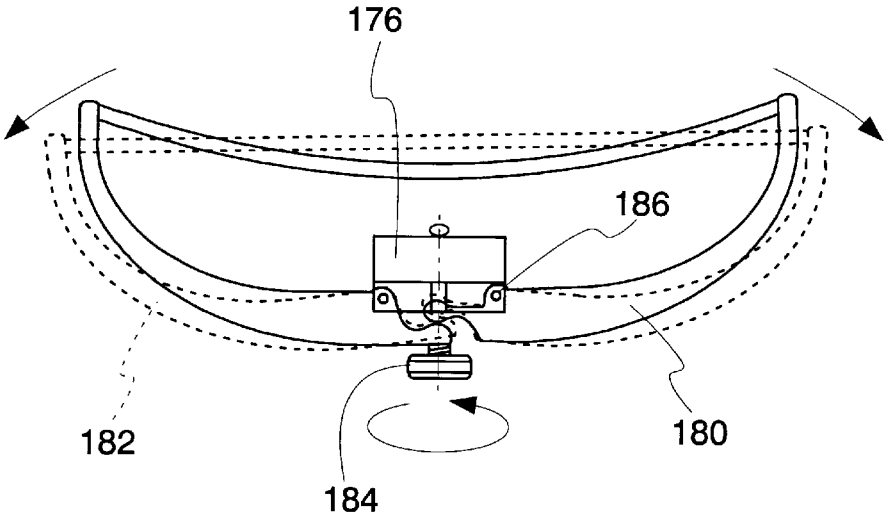
Figure 25:
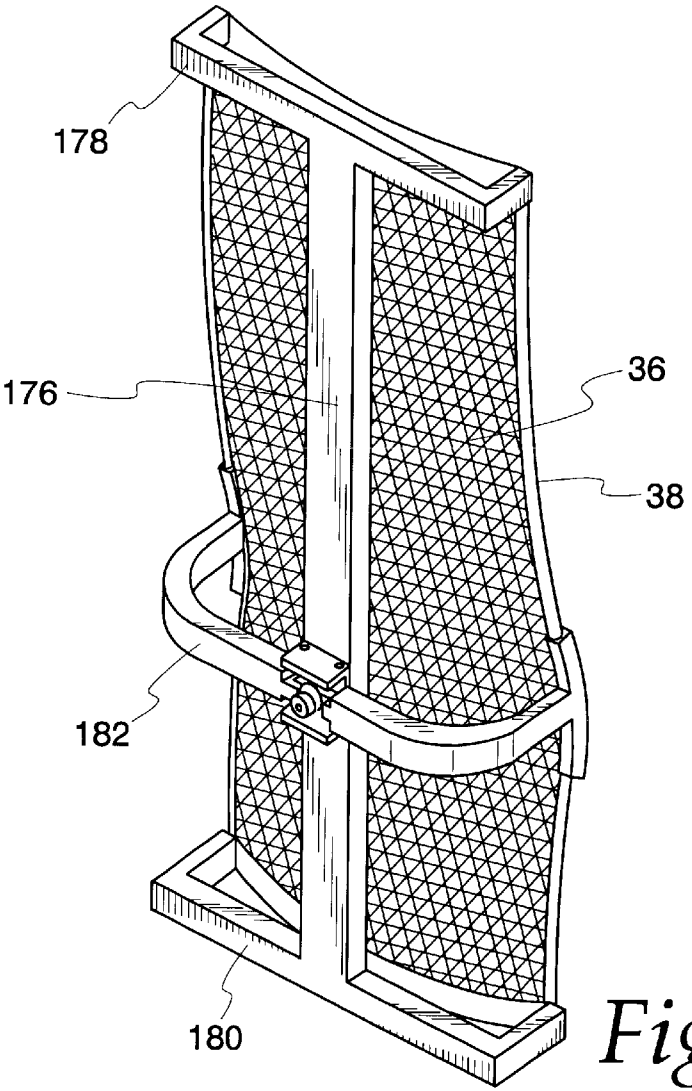

FIGS. 25 and 26 illustrate an embodiment wherein a central support 176 and braces 178, 180 are used. A two piece lumbar support member 182 is employed to adjust tension in the mesh 36 by means of a manually rotatable knob 184 and camming device 186.

Figure 28:
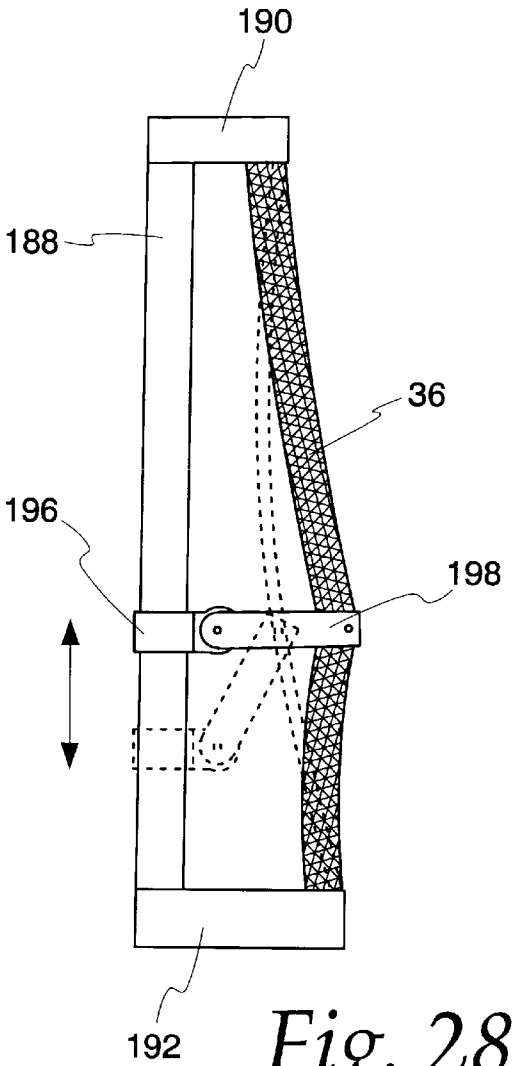
Figure 27:
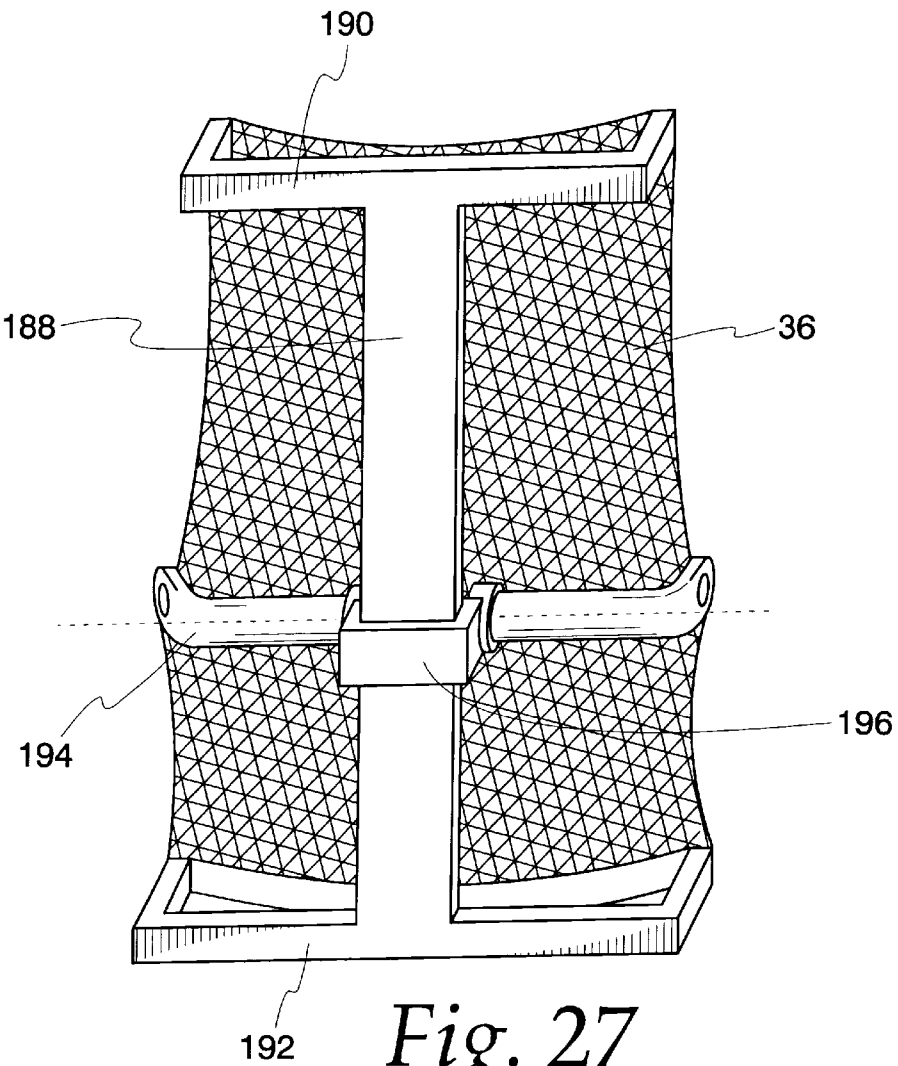

FIGS. 27 and 28 show yet another embodiment wherein a central support 188 and braces 190, 192 are used. In this construction a lumbar support member 194 is connected by a slideable bracket 196 to the support 188 and uses a link member 198 to adjust tension in the mesh 36.

Figure 30:
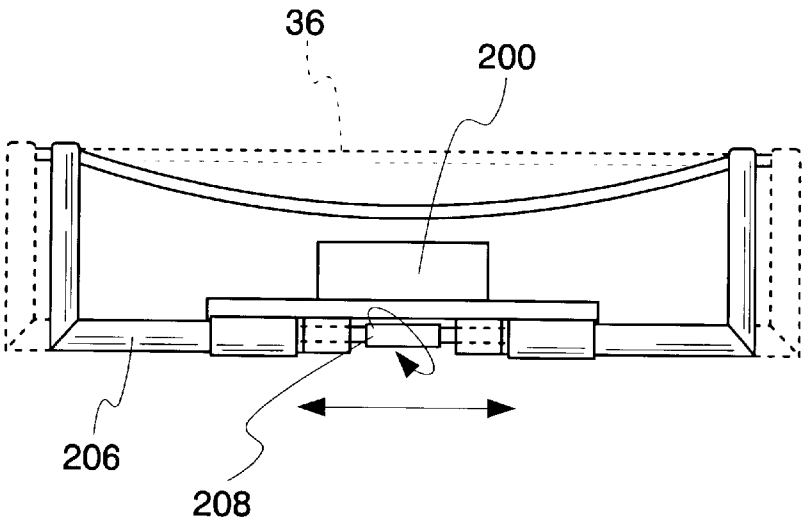
Figure 29:
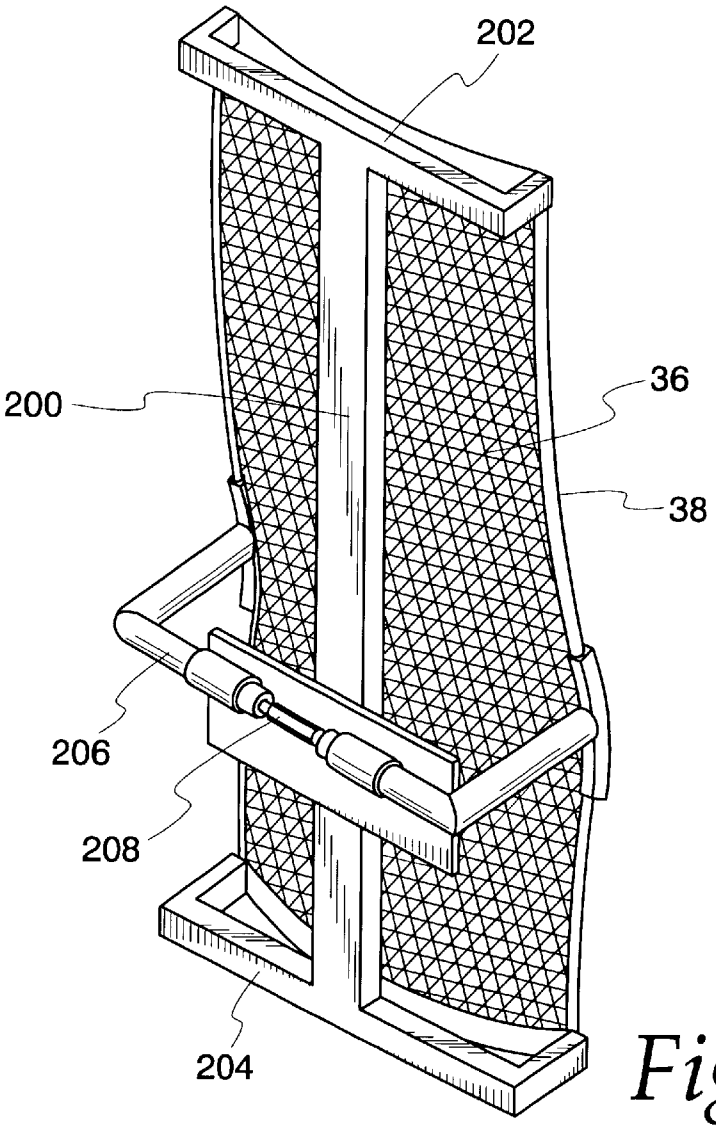

FIGS. 29 and 30 show a further embodiment wherein a central support 200 and braces 202, 204 are used. In this construction a two piece lumbar support member 206 is employed using a turnbuckle assembly 208 to adjust tension in the mesh 36.

Figure 31:
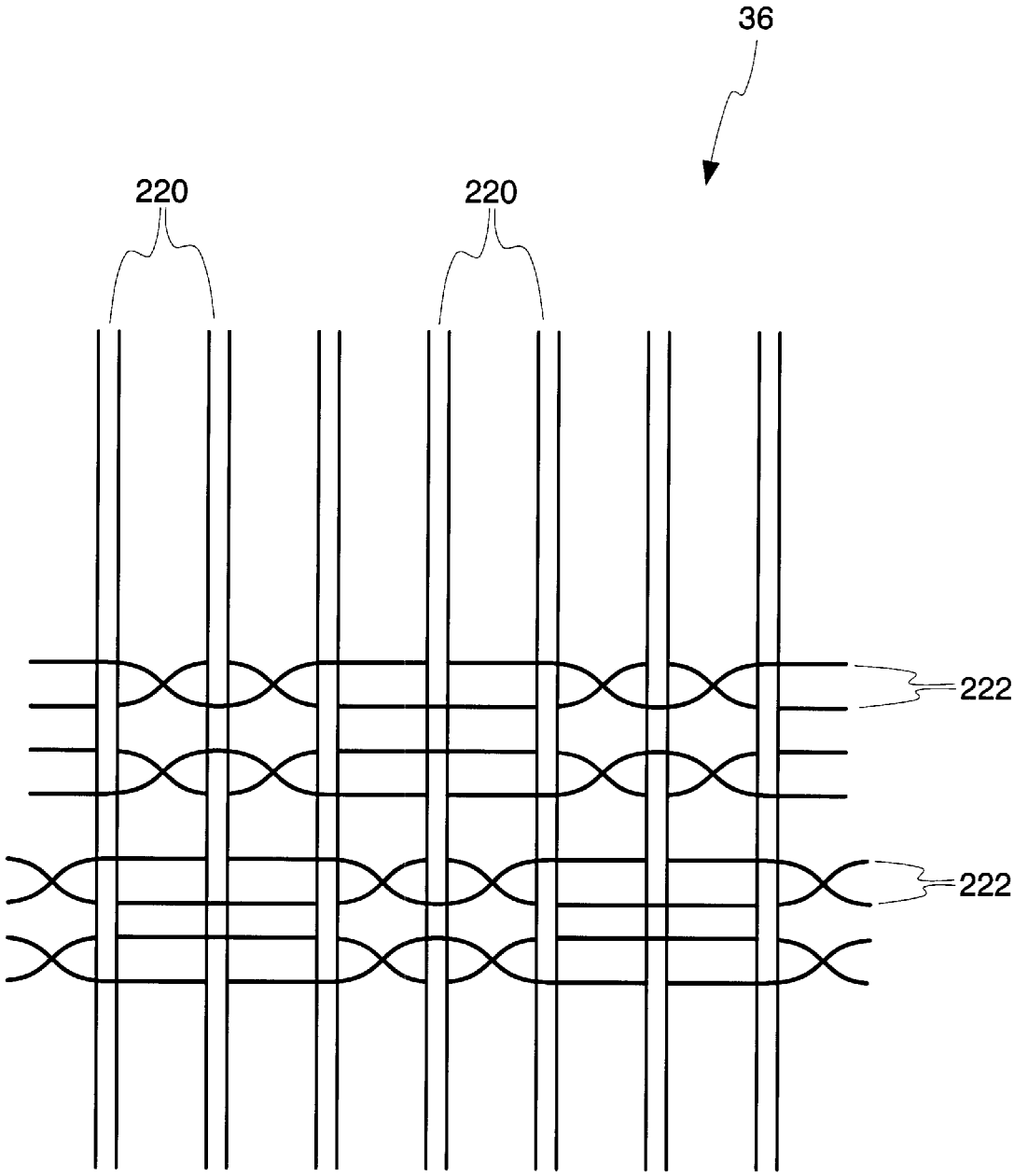
FIG. 31 is an enlarged diagrammatic plan view of a portion of fabric mesh suitable for use in the present chair back construction.

Yet another novel feature of the chair 10 that offers ergonomic advantages over the prior art is the construction of the chair back 14. As previously noted, the back 14 is designed to be formed of a panel of fabric mesh 36 which is preferably of an open weave type known in the art. The construction of the fabric mesh 36 may have a variety of weave configurations. One configuration that has proved to be advantageous is shown in FIG. 31 comprising vertical strands 220 of multifilament yarn and horizontal monofilaments 222. The monofilaments 222 in this construction can be seen to cross over the strands 220 and also crisscross over each other thereby locking the strands 220 in place.

Figure 32:
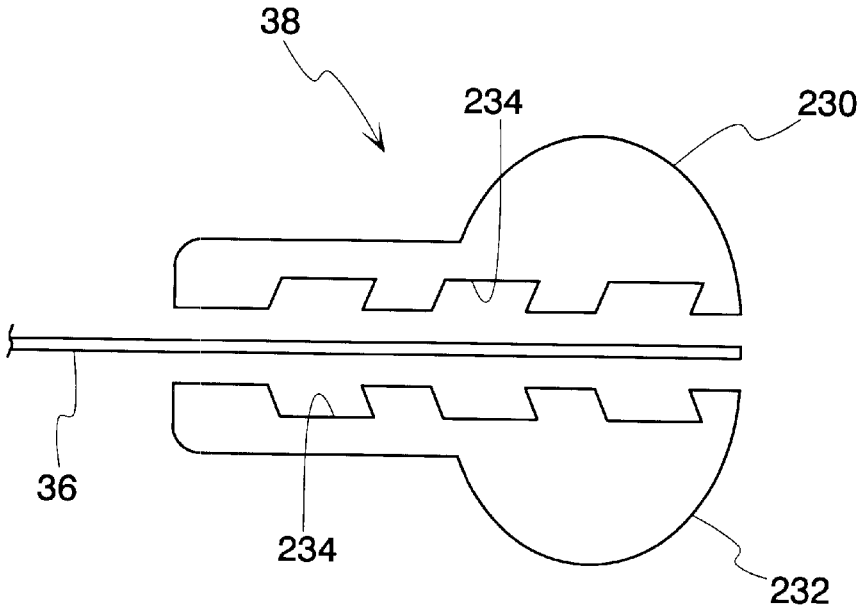
FIG. 32 is an exploded sectional view of a carrier and mesh attachment system.
Figure 33:
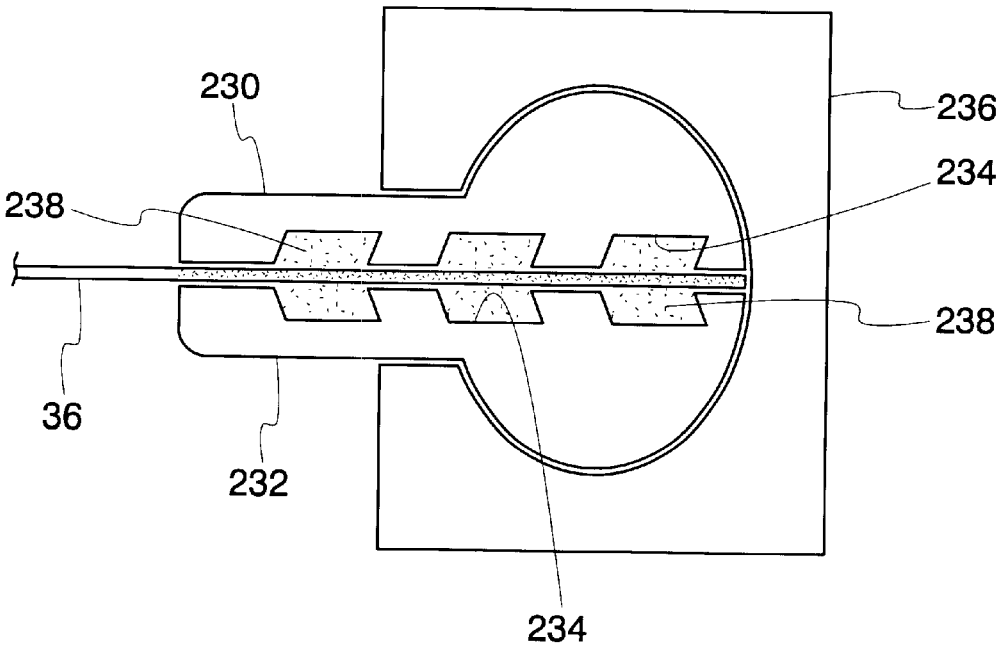
FIG. 33 is a sectional view of a connected carrier and mesh attachment system.

In order to support the mesh 36 around its edges, the carrier 38 is used. The physical connection of the carrier 38 to the mesh 36 may be performed in a number of ways. However, a most reliable connection is disclosed in co-pending U.S. patent application, application Ser. No. 09/656,491, filed by Timothy P. Coffield on Sep. 6, 2000 and titled "Bonding Strip For Load Bearing Fabric." FIGS. 32 and 33 illustrate a carrier 38 comprising two pieces or halves 230 and 232 disposed on opposite sides of the edge portion of the mesh 36. The two halves 230 and 232 may, in one form, be formed with internal grooves 234. The halves are placed in a fixture 236 together with an adhesive 238. The adhesive extends through warps and wefts of the fabric 36 and into the grooves 234 and, once cured, creates a mechanical interconnection that is of high strength and durability.

Figure 34:
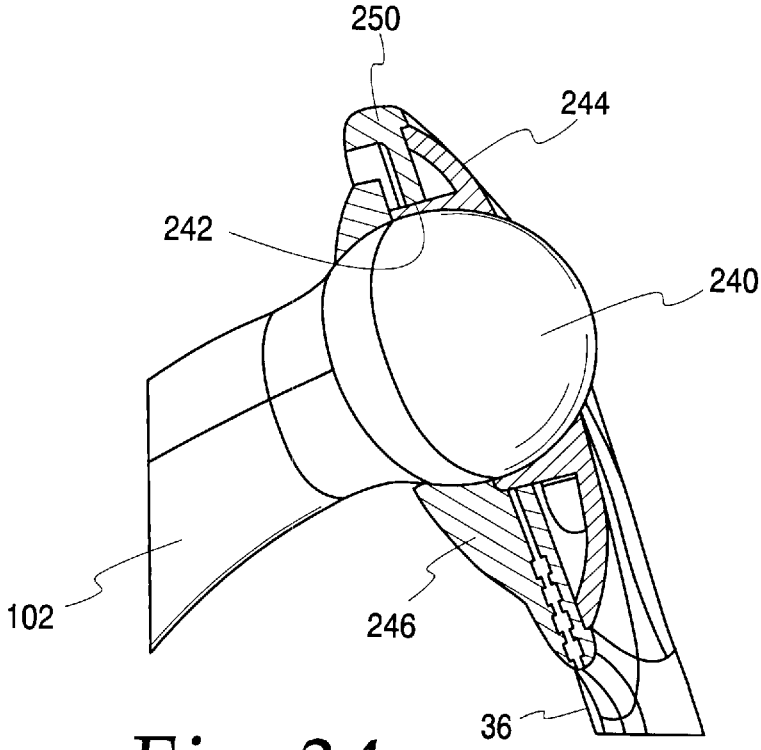
FIG. 34 is an enlarged a sectional view taken along line 34—34 of FIG. 15.
Figure 35:
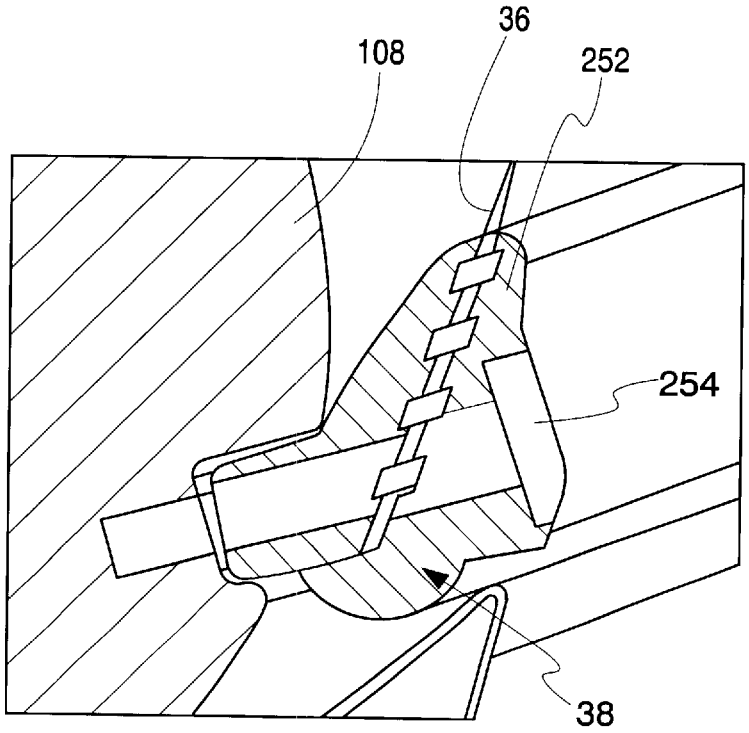
FIG. 35 is an enlarged a sectional view taken along line 35—35 of FIG. 15.
Figure 34A:
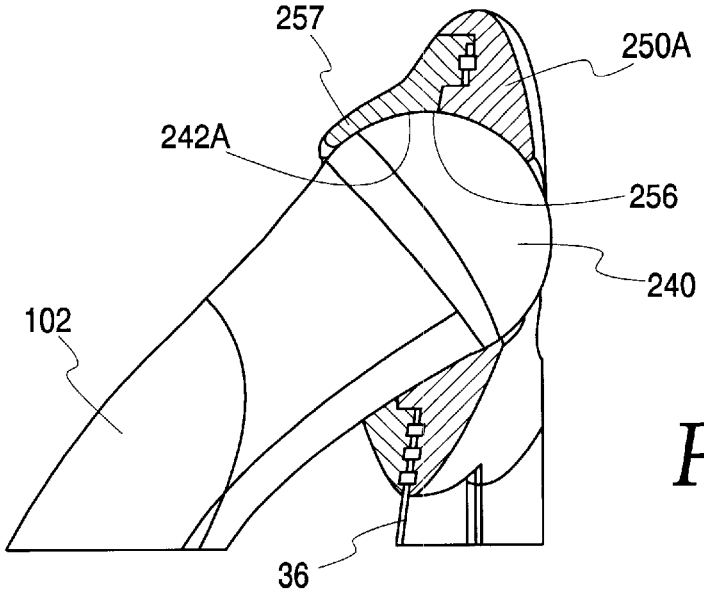
FIG. 34A is an enlarged a sectional view taken along line 34A—34A of FIG. 15A
Figure 35A:
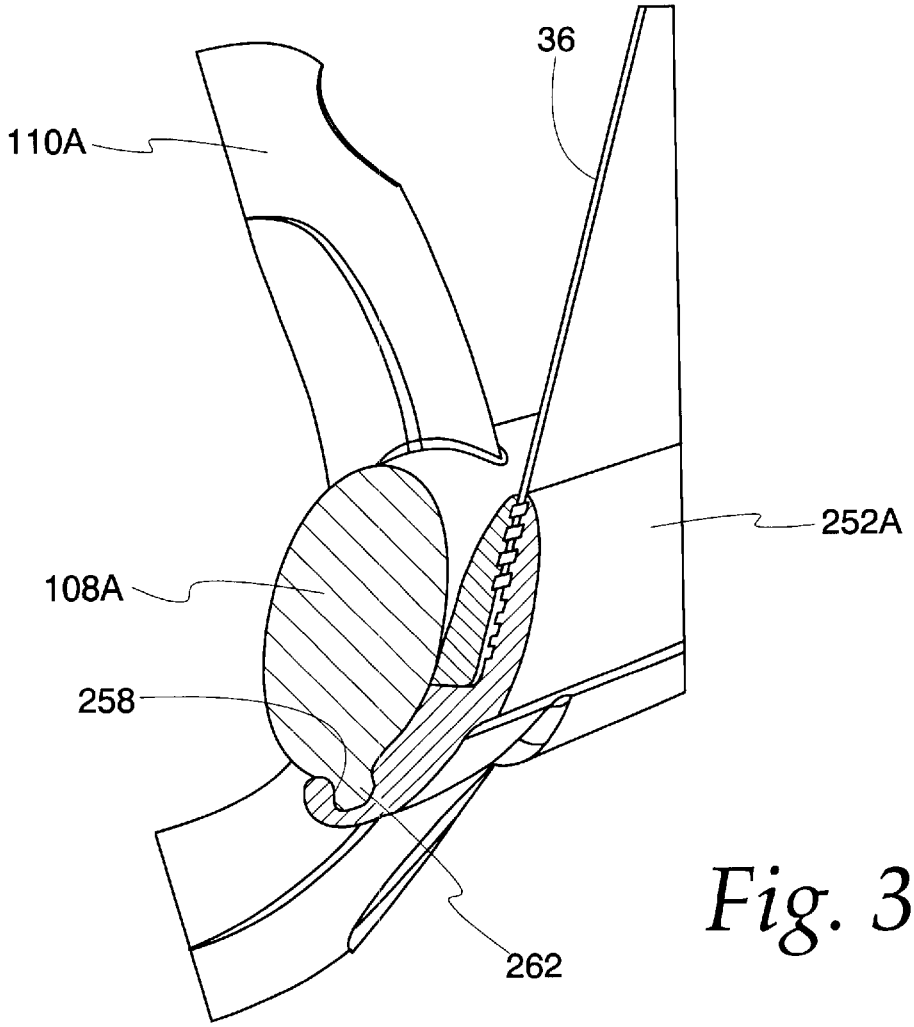
FIG. 35A is an enlarged a sectional view taken along line 35A—35A of FIG. 15A.

Referring again to FIG. 16, in order to support the chair back 14, the main back frame 34 has spherical end portions 240 formed on the vertical support members 102 which are received within circular apertures 242 formed in the upper right and upper left hand corners of the carrier 38. Suitable retainers 244 and 246, one on each side of the carrier 38, are attached as by screws 248 around each spherical end portion 240 to essentially create ball and socket joints. These joints allow an upper edge 250 of the carrier 38 to flex allowing the chair back 14 to comfortably conform to the position of the user's shoulders. The carrier 38 may be secured along a bottom edge 252 to the frame member 108 by screws 254. Details of the upper ball and socket connections may be seen in the cross-sectional view of FIG. 34, while the lower attachment construction can be seen in detail in FIG. 35.

Another embodiment of the carrier, the mesh and the maimer of connecting them to the vertical support members and the transverse member are shown in FIGS. 15A 16*a* 16B 16C 34A and 35A. In those figures, the chair back 14A includes the mesh 36 attached to a carrier 38A. The carrier 38A mounts the lumbar support tube 120 as already described but attaches to the vertical support members 102 and the transverse member 108A in a different maimer than previously described for the chair back 14.

At the upper corners of the carrier 38A there are openings 242A in the upper edge 250A of the carrier. However, the rims 256 around the openings include extending arms 257 to more fully grip the spherical end portions 240 of the vertical support members 102.

At the bottom of the carrier 38A the bottom edge 252A includes a longitudinally extending groove 258. The transverse member 108A includes five downwardly extending tabs 260, 262, 264, 266, 268. These tabs engage with the groove 258. It can now be appreciated that the mesh/carrier may be assembled quite easily by stretching the mesh/carrier over the tabs in the transverse member and the two spherical end portions. This creates a tension in the mesh and the carrier which develops a downward force on the spherical end portions and an upward force on the tabs of the transverse member. This tension maintains the mesh/carrier in place and stiffens the mesh. The arrangement also allows quick and easy assembly without the need for fasteners or extra hardware.

It can now be appreciated that a chair back construction as just described offers considerable ergonomic advantages. The use of open mesh 36 allow the chair backs 14, 14A to not only breathe, but to flex in conformity with the back of the user. The chair backs 14, 14A are also highly cost effective to manufacture and assemble.

The specification above describes in detail several preferred embodiments of the present invention. Other examples, embodiments, modifications and variations will under both the literal claim language and the doctrine of equivalents come within the scope of the invention defined by the appended claims. For example, the type of mesh used, the shape of the carrier, the precise shape of the material surrounding the upper comer openings in the carrier, the number, shape and placement of the tabs are all considered equivalent structures and will also come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A chair back comprising:

a stretchable material for engaging a back of a chair user; and a generally rectangular and stretchable carrier connected to said back engaging material, said carrier having top, bottom and side edges and configured to directly engage a chair frame assembly only along said bottom edge of said carrier and at upper corners where said side edges and top edge of said carrier intersect.

2. An apparatus as claimed in claim 1 wherein:

said bottom edge of said carrier includes a groove extending substantially along the length of said bottom edge adapted to engage a complementary projection of the chair frame assembly.

3. An apparatus as claimed in claim 1, wherein:

said upper corners of said carrier are each configured with an opening for receiving a spherical member of said chair frame assembly wherein said spherical member protrudes partially through said opening.

4. An apparatus as claimed in claim 1 wherein:

said carrier is a two-piece structure; and edges of said material are restrained between the two pieces of the two-piece structure.

5. An apparatus as claimed in claim 3 wherein:

said bottom edge of said carrier includes a longitudinally extending groove adapted to engage a complementary projection of the chair frame assembly.

6. An apparatus as claimed in claim wherein:

said carrier is a two-piece structure; and edges of said material are restrained between the two pieces of the two-piece structure.

7. An apparatus as claimed in claim 6 wherein:

said carrier is connected to said chair frame assembly by stretching said lower portion of said carrier over a lower portion of said chair frame assembly and by stretching said upper portion of said carrier over an upper portion of the chair frame assembly.

8. An apparatus as claimed in claim 7 wherein:

said lower portion of said chair frame assembly includes a plurality of tabs for engaging said groove of said carrier.

9. A chair back comprising:

a material for engaging a back of a chair user;

a carrier connected to said back engaging material, said carrier configured to connect to a chair frame assembly only along a lower portion of said carrier and along an upper portion of said carrier;

said chair frame assembly includes a vertical support member; and including a transverse member mounted to engage said vertical support member of said chair frame assembly, said transverse member having opposed end portions for slidable engagement with side edges of said carrier.

10. An apparatus as claimed in claim 9 wherein:

said transverse member is configured to force said side edges of said carrier forwardly of said chair back in the lumbar region of a chair user.

11. A chair back comprising:

a material for engaging a back of a chair user;

a carrier connected to said back engaging material, said carrier configured to connect to a chair frame assembly only along a lower portion of said carrier and along an upper portion of said carrier;

said carrier is connected to the chair frame assembly at a bottom edge of the carrier and at two upper corners of the carrier;

said two upper corners of said carrier are each configured with an opening adapted to receive a spherical member of said chair frame assembly;

said lower portion of said carrier includes a longitudinally extending groove adapted to engage a complementary projection of the chair frame assembly;

said carrier is a two-piece structure;

edges of said material are restrained between the two pieces of the two-piece structure;

said carrier is connected to said chair frame assembly by stretching said lower portion of said carrier over a lower portion of said chair frame assembly and by stretching said upper portion of said carrier over an upper portion of the chair frame assembly;

said lower portion of said chair frame assembly includes a plurality of tabs for engaging said groove of said carrier;

said chair frame assembly includes a vertical support member; and including a transverse member mounted to engage said vertical support member of said chair frame assembly, said transverse member having opposed end portions for slidable engagement with side edges of said carrier.

12. An apparatus as claimed in claim 10 wherein:

said transverse member slides along said vertical support.

13. An apparatus as claimed in claim 12 wherein:

said transverse member includes gripping members; and said gripping members and said edges of said carrier engage each other using a tongue and groove arrangement.

14. An apparatus as claimed in claim 1 wherein:

said carrier is pivotal under the influence of a chair user; and said carrier is connected to a chair seat which pivots in response to the pivot of said carrier.

15. An apparatus as claimed in claim 11 wherein:

said carrier is pivotal under the influence of a chair user; and said carrier is connected to a chair seat which pivots in response to the pivot of said carrier.

* * * * *